US005822663A

United States Patent [19]

Ichikawa et al.

[11] Patent Number: 5,822,663

[45] Date of Patent: Oct. 13, 1998

[54] DEVELOPER REPLENISHING DEVICE AND DEVELOPER CONTAINER FOR USE THEREWITH

[75] Inventors: Hideo Ichikawa, Numazu; Takeshi Saito, Tokyo; Sunao Ikeda, Numazu; Nobuhiro Makita, Numazu; Seiji Ozawa, Numazu; Shigeru Yoshiki, Kawasaki; Takaaki Yanagisawa, Yokohama, all of Japan

[73] Assignee: Ricoh Company, Ltd., Tokyo, Japan

[21] Appl. No.: 751,617

[22] Filed: Nov. 18, 1996

Related U.S. Application Data

[63] Continuation of Ser. No. 587,966, Jan. 17, 1996, Pat. No. 5,627,631, which is a continuation of Ser. No. 386,875, Feb. 10, 1995, Pat. No. 5,500,719, which is a continuation of Ser. No. 174,698, Dec. 28, 1993, Pat. No. 5,455,662.

[30] Foreign Application Priority Data

Dec. 30, 1992 [JP] Japan ..... 4-361012

[51] Int. Cl.[6] ..... G03G 15/08

[52] U.S. Cl. ..... 399/262; 399/258; 399/120; 215/384; 220/756; 222/DIG. 1

[58] Field of Search ..... 399/262, 119, 399/120, 258; 141/363, 364; 215/383, 384; 220/755, 756, 771; 222/DIG. 1, 167, 325

[56] References Cited

U.S. PATENT DOCUMENTS

| | | | |
|---|---|---|---|
| D. 193,637 | 9/1962 | Ferraro | D9/556 |
| 3,185,353 | 5/1965 | Mercier | 215/384 X |
| 3,853,246 | 12/1974 | Dubois . | |
| 3,915,340 | 10/1975 | Koeleman | 222/167 X |
| 3,979,026 | 9/1976 | Lee . | |
| 4,060,105 | 11/1977 | Feldeisen et al. | 222/DIG. 1 |
| 4,436,203 | 3/1984 | Reyner | 206/524.8 |
| 4,611,730 | 9/1986 | Ikesue et al. | 222/167 |
| 4,641,945 | 2/1987 | Ikesue et al. | 399/262 |
| 4,744,493 | 5/1988 | Ikesue et al. | 399/262 X |
| 4,878,603 | 11/1989 | Ikesue et al. | 399/262 X |
| 5,057,872 | 10/1991 | Saijo et al. . | |
| 5,217,737 | 6/1993 | Gygax et al. | 215/373 X |
| 5,218,407 | 6/1993 | Matsushita et al. | 399/29 |
| 5,409,750 | 4/1995 | Hamada et al. | 215/44 X |
| 5,441,177 | 8/1995 | Yanagisawa | 222/167 |
| 5,495,323 | 2/1996 | Meetze, Jr. | 222/167 X |
| 5,528,349 | 6/1996 | Satake | 399/262 |
| 5,557,381 | 9/1996 | Sakamoto et al. | 399/111 |
| 5,557,382 | 9/1996 | Tatsumi et al. | 399/262 |
| 5,589,919 | 12/1996 | Ikunami et al. | 399/262 |
| 5,598,254 | 1/1997 | Ikesue et al. | 399/262 |
| 5,648,840 | 7/1997 | Ikunami et al. | 399/262 |

FOREIGN PATENT DOCUMENTS

| | | |
|---|---|---|
| 0 441 227 A2 | 8/1991 | European Pat. Off. . |
| 63-075769 | 4/1988 | Japan . |

*Primary Examiner*—Matthew S. Smith

*Attorney, Agent, or Firm*—Oblon, Spivak, McClelland, Maier & Neustadt, P.C.

[57] ABSTRACT

A developer replenishing device for replenishing a developing device with a developer, and a developer container for use therewith. The developer container, or toner bottle, has a mouth portion at one end thereof which is smaller in diameter than a hollow cylindrical main body. At the end of the bottle provided with the mouth, a shoulder has the inner periphery thereof partly raised to the edge of the mouth portion to form a raised portion for scooping up a toner. In addition, a part of the inner periphery of the circumferential wall of the bottle which is contiguous with the raised portion is also raised toward the axis of the bottle about which the bottle is rotatable, thereby forming another raised portion. When the bottle is mounted to a bottle holder, which is included in the replenishing device, substantially horizontally with the mouth portion oriented sideways, the bottle is rotated to raise the toner from the bottom of the main body to the mouth portion. As a result, the toner is discharged to the outside via the mouth portion smoothly.

4 Claims, 42 Drawing Sheets

DEVELOPER REPLENISHING DEVICE AND DEVELOPER CONTAINER FOR USE THEREWITH

This is a Continuation, of application Ser. No. 08/587,966 filed on Jan. 17, 1996, now U.S. Pat. No. 5,627,631 which is a Continuation of Ser. No. 08/386,875 filed on Feb. 10, 1995, now U.S. Pat. No. 5,500,719; which is a Continuation of application Ser. No. 08/174,698 filed on Dec. 28, 1993, now U.S. Pat. No. 5,455,662.

BACKGROUND OF THE INVENTION

The present invention relates to a developing device included in a copier, facsimile apparatus, printer or similar image forming apparatus and, more particularly, to a developer replenishing device for replenishing the developing device with a developer, and a developer container for use therewith.

There has been extensively used a copier, facsimile apparatus, printer or similar electrophotographic image forming apparatus which electrostatically forms a latent image on a photoconductive element, develops the latent image with charged color particles, i.e., developer, and then transfers the developed image to a paper. It is a common practice with this type of apparatus to supplement a fresh developer when a developer stored in a vessel is consumed. A device for replenishing the developer may be implemented with a hollow cylindrical container storing the developer, as taught in, for example, Japanese Patent Laid-Open Publication (Kokai) Nos. 59-188678 and 60-146265. The container is substantially entirely open at one end thereof to form a developer outlet and is rotated about the longitudinal axis thereof to sequentially discharge the developer, or powder, to the vessel of the image forming apparatus via the outlet. To replace the container with a new container filled with a fresh developer, a holder positioned horizontally on the body of the image forming apparatus is rotated downward to a vertical position about one end thereof. In this condition, the empty container is removed from the holder, and then a new container is mounted to the holder. Subsequently, the holder is again rotated to the horizontal position where the new container can replenish the apparatus with the developer. Before the new container is put on the holder maintained in the vertical position, the container is positioned such that the opening, or developer outlet, thereof faces upward, and then a cap closing the opening is removed. The container without the cap is mounted to the holder with the opening facing upward, so that the powder filling the container may not fall.

However, the prerequisite with the conventional scheme described above is that the length of the holder should not be greater than the height of the apparatus since the holder has to be rotated between the horizontal position and the vertical position about one end thereof. Generally, the apparatus is provided with as small a height as possible to meet the demand for a miniature configuration, requiring the holder and, therefore, the container to be as short as possible. As a result, the quantity of developer available with a single container is reduced, resulting in the frequent replacement of the container. In any case, the conventional replenishing device cannot be reduced in size and suffers from design limitations in relation to the internal arrangement of an image forming apparatus.

In the light of the above, we conducted a series of studies and experiments in order to implement an arrangement for allowing a person to replace the cylindrical container while maintaining the holder in the horizontal position. However, since the container is substantially fully open at one end thereof, the developer stored therein falls via the outlet of the container when the container is mounted to the holder. We, therefore, have proposed in Japanese Patent Laid-Open Publication No. 3-2881 a developer replenishing device using a container which is closed at both ends thereof and formed with a developer outlet in the circumferential wall thereof adjacent one of the closed ends. This kind of container is placed on a holder with the outlet facing upward. However, considering the fact that an image forming apparatus is used by ordinary clerks, it is likely that the container is inadvertently mounted to the holder with the outlet facing downward. Then, the developer will fall from the container and smear the apparatus and floor. In addition, a dead space is produced between the outlet and the adjoining end of the container, requiring the container to be provided with an additional length matching the dead space.

SUMMARY OF THE INVENTION

It is, therefore, an object of the present invention to provide a new and improved developer replenishing device free from the drawbacks discussed above.

It is another object of the present invention to provide a developer replenishing device which prevents a developer from falling from a container despite that the container is set in a horizontal position.

It is another object of the present invention to provide a new and improved developer container for use with such a developer replenishing device.

It is another object of the present invention to provide a developer container capable of replenishing a developing device installed in an image forming apparatus with all the developer stored therein.

In accordance with the present invention, in a developer container for use with a developer replenishing device a holder for holding the developer container to allow a developer to be discharged from a mouth portion of the developer container into the developer replenishing device, and a drive unit for causing the developer container held by the holder to rotate about the axis thereof, there is provided a hollow cylindrical main body having the mouth portion on one end. The mouth portion is smaller in diameter than a shoulder portion which forms a circumferential wall adjacent the one end. A guide portion is provided on a part of the shoulder portion for guiding the developer stored in the developer container to the mouth portion.

Also, in accordance with the present invention, in a toner bottle for use with a toner replenishing device having a bottle holder into which a mouth portion of the toner bottle may fit for discharge of a toner in the toner bottle into the toner replenishing device, and a drive unit which rotatably drives the toner bottle when the toner bottle is mounted to the toner replenishing device, there are provided a main body comprising a substantially hollow container having, adjacent one end of the toner bottle, a first diameter portion, a discharge mouth at the one end, the discharge mouth comprising the mouth portion and having a second diameter substantially smaller than the first diameter, and a circumferential and radially extending ramp surface configuration of the peripheral surface of the main body at the one end and connecting radially between the first diameter portion and a radial position no greater than the second diameter portion.

Further, in accordance with the present invention, in toner bottle for use with a toner replenishing device having a bottle holder into which a mouth portion of the toner bottle may fit for discharge of a toner in the toner bottle into the toner replenishing device, and a drive unit which rotatably drives the toner bottle about a longitudinal axis thereof when the toner bottle is mounted to the toner replenishing device, there are provided a main body comprising a substantially hollow container, and a rotational force transfer projection or recess on the radially extending surface of the main body and cooperating with the bottle holder for transferring the rotation of the bottle holder to the toner bottle.

Moreover, in accordance with the present invention, in toner bottle for use with a toner replenishing device having a mouth portion for discharge of toner in the toner bottle into the toner replenishing device, and a drive unit which rotatably drives the toner bottle when the toner bottle is mounted to the toner replenishing device, there are provided a main body comprising a substantially hollow container having, adjacent one end of the bottle, a first diameter portion, a discharge mouth at the one end, the discharge mouth comprising the mouth portion and having a second diameter substantially smaller than the first diameter, and a circumferential and radially extending ramp surface configuration of the main body at the one end and connecting radially between the first diameter portion and a radial position no greater than the second diameter portion such that a controllable quantity of toner in the toner bottle is raised radially from the first diameter portion to the second diameter portion for feeding the controllable quantity of toner to the discharge mouth when the toner bottle is rotated by the drive unit.

In addition, in accordance with the present invention, a device for replenishing a developing device of an image forming apparatus with a developer comprises a developer container containing a developer and having a mouth portion, and a holder communicated to a developer replenishing section for holding the developer container while orienting the mouth portion toward the developer replenishing section. The holder is rotatable about one end in a substantially horizontal plane.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

A preferred embodiment of the present invention will be described which is applied to an electrophotographic copier belonging to a family of image forming apparatuses.

Figure 1A:
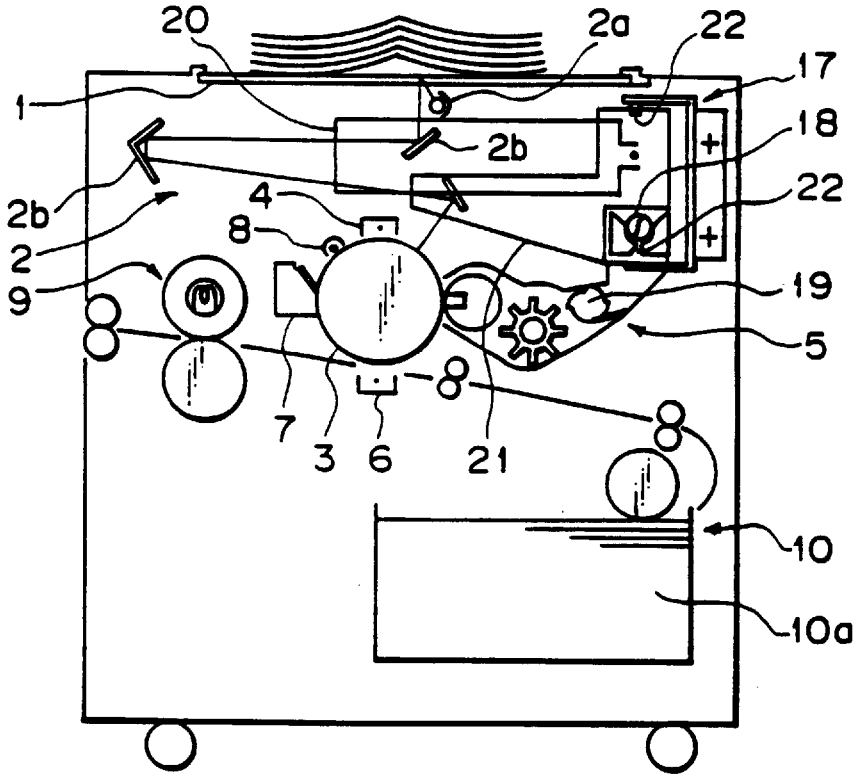
FIGS. 1A and 1B are respectively a section and a front view, showing a copier to which the present invention is applicable.

Referring to FIG. 1A, the copier has a glass platen 1 on the top thereof for laying a document to be copied. An optical unit 2 is disposed below the glass platen 1 and includes a lamp 2*a* for illuminating the document, a mirror 2*b*, and a lens, not shown. A photoconductive element in the form of a drum 3 is rotatably located below the, optical unit 2. Arranged around the drum 3 are a main charger 4, a developing unit 5, a transfer charger 6, a cleaning unit 7, a discharger 8 and other conventional units for implementing an electrophotographic process. A fixing unit 9 is positioned at the left-hand side of the drum 3, as viewed in the figure, for fixing a toner image transferred from the drum 3 to a paper by the transfer charger 6. A paper feed section 10 is provided in the lower portion of the copier and loaded with a stack of papers 10*a*. The papers 10*a* are sequentially fed from the paper feed section 10 to the drum 3. The operation of this kind of copier is well known in the art and will not be described specifically.

Figure 2:
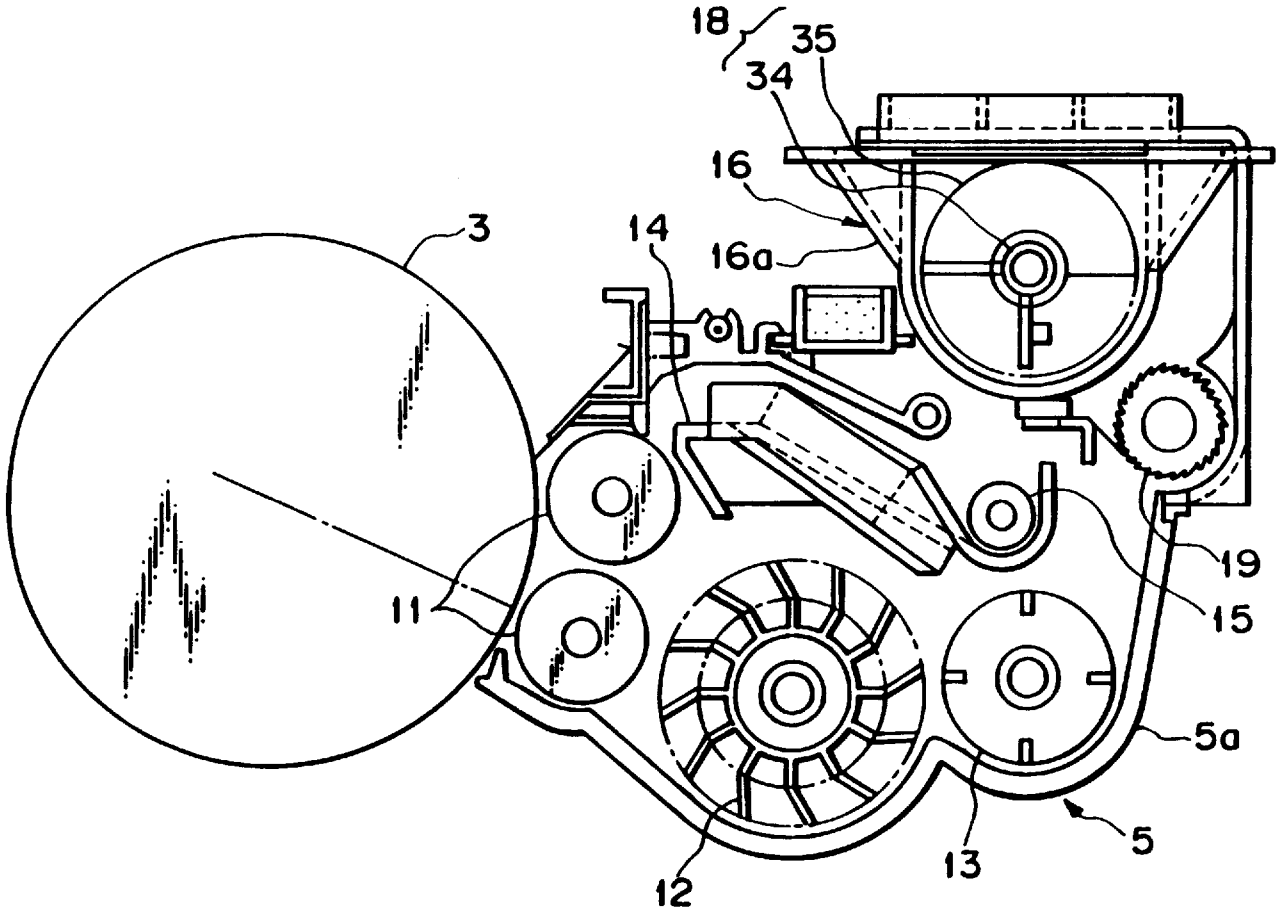
FIG. 2 is a section showing the general construction of a developing device incorporated in the copier.

As shown in FIG. 2, the developing unit 5 is a conventional dry process unit using a two component type developer, i.e., a toner and carrier mixture. The developing unit 5 has a casing 5*a* accommodating developing rollers 11, a paddle wheel 12 for agitation, a mixing roller 13, a separator 14, a horizontally extending screw 15 for agitation, etc. A hopper 16 is contiguous with the casing 5 and disposed above such constituents of the developing unit 5. A toner is supplied from the hopper 16 into the developing unit 5. A screw conveyor 18 is accommodated in the hopper 16 and made up of a shaft 34 and a spiral member 35 affixed to the shaft 34. The screw conveyor 18 conveys a toner from a toner supply unit 17 while agitating it, as will be described in detail later. A toner supply roller 19 is disposed in a portion where the hopper 16 is communicated to the developing unit 5, and it is rotated in response to the output signal of a toner concentration sensor, not shown.

Figure 1B:
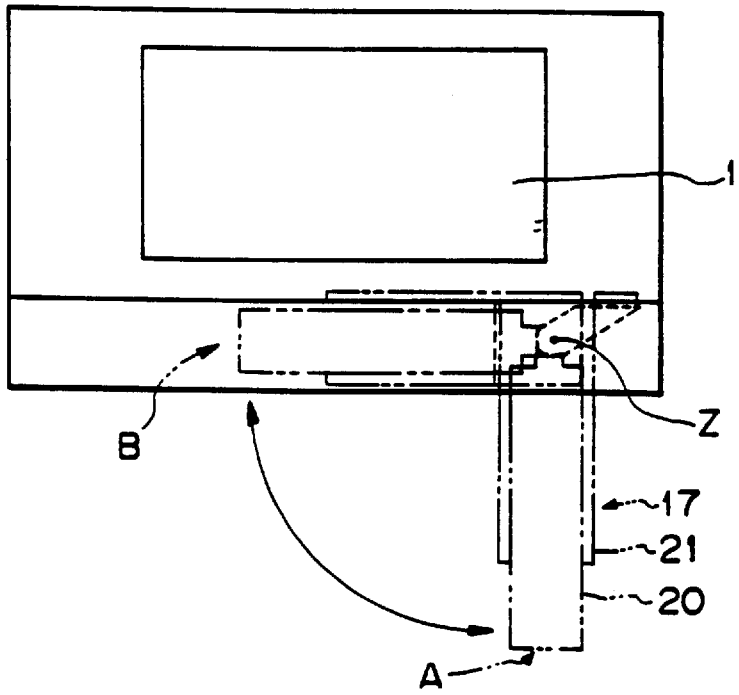

As shown in FIG. 1A, the toner supply unit 17 is located in the upper front portion of the copier and includes a bottle holder 21. The bottle holder 21 plays the role of holding means for holding a toner bottle, or developer container, 20. As shown in FIG. 1B, the bottle holder 21 is mounted on a shaft 22, FIG. 1A, which is located at the right end of the unit 17. The bottle holder 21 is rotatable about 90 degrees about the axis Z of the shaft 22 in a substantially horizontal plane. Specifically, the bottle holder 21 is movable between two positions A and B, as illustrated, in the position A, the left portion of the bottle holder 21 is pulled out toward the front end of the copier to allow the bottle 20 to be mounted thereto. In the position B, the entire unit 17 remains parallel to the front end of the copier. The bottle holder 21 is formed with an opening in the bottom wall thereof for letting a toner to fall therethrough. At least in the position B, the bottom opening of the bottle holder 21 is positioned above a toner receiving portion 16*a*, FIG. 2, included in the hopper 16 and extending to the front end of the copier. Preferably, the toner supply unit 17 is located inwardly of a front cover, not shown, which covers the front end of the copier; when the front cover is opened, the unit 17 can be pulled out to the position A.

Figure 3A:
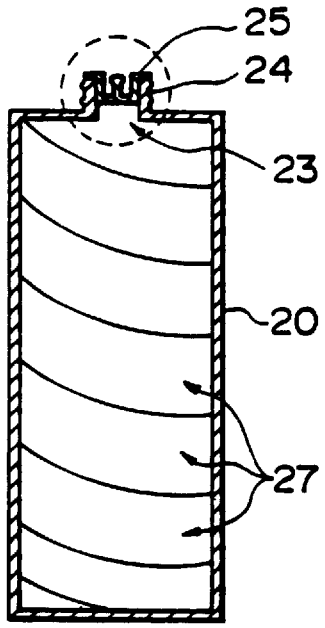
FIGS. 3A and 3B are respectively a section and a fragmentary enlarged view, showing a toner bottle for use with the copier.
Figure 3B:
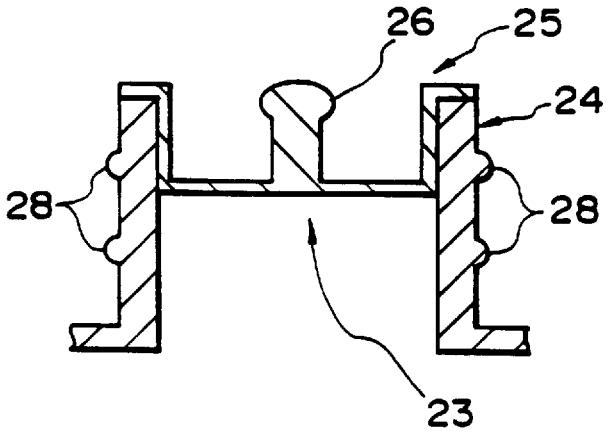

FIG. 3A shows a specific configuration of the toner bottle 20 while FIG. 3B shows a mouth portion 23 forming the outlet of the bottle 20. As shown, the bottle 20 is substantially cylindrical and provided with the mouth portion 23 at substantially the center of one end thereof. The mouth portion 23 has a smaller diameter than the cylinder constituting the bottle 20 and has a circular section. In the specific configuration, the mouth portion 23 is formed at the end of a collar 24 extending out from the cylinder 20 and is plugged by a lid 25. A mushroom-like lug 26 protrudes from the center of the lid 25. A spiral guide groove 27 is formed in the inner periphery of the cylinder 20, as in the bottle taught in previously mentioned Japanese Patent Laid-Open Publication No. 59-188678. When the bottle 20 is rotated about the longitudinal axis thereof, the spiral groove 27 guides the toner contained in the bottle 20 toward the mouth portion 23.

Annular ribs 28 are formed on the outer periphery of the collar 24. A cap 29 (see FIG. 12A) closes the entire collar 24 while mating with the ribs 28 during the transport of the bottle 20. In this sense, the ribs 28 constitute an engaging portion. For this purpose, the cap 29 is provided with lugs or grooves on the inner periphery thereof which are complementary to the ribs 28.

Figure 4A:
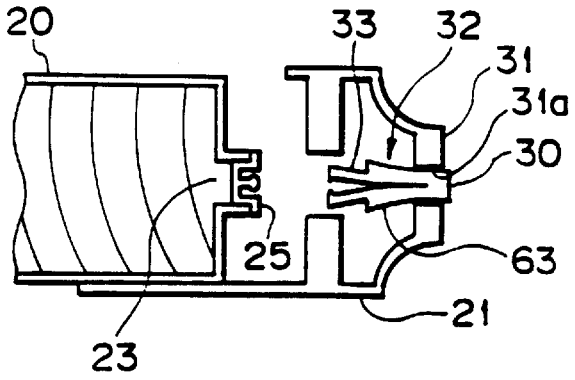
FIGS. 4A–4C show a sequence of steps for removing a lid from the toner bottle.
Figure 4B:
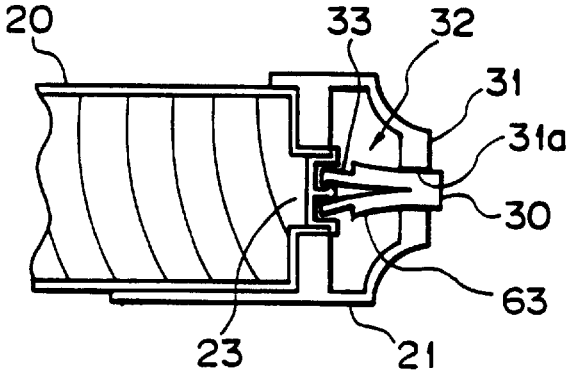
Figure 4C:
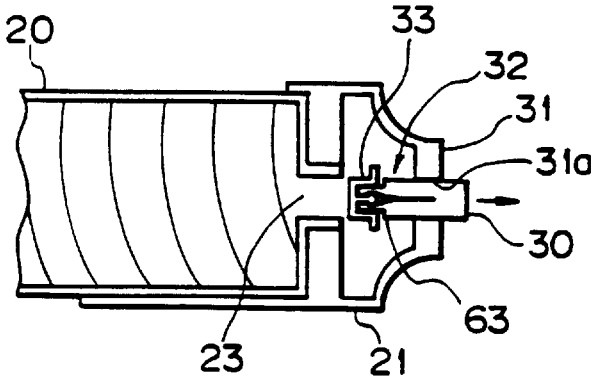

FIGS. 4A–4C show a mechanism 32 for removing the lid 25 from the mouth portion 23 of the bottle 20. As shown, the mechanism 32 is made up of a collet chuck, or retaining means, 30 and moving means, not shown, for moving the chuck 30 toward and away from the bottle 20. The collet chuck 30 has a chucking portion 33 at the tip thereof and is supported by a hole 31*a* formed in a wall 31 which forms a part of the bottle holder 21. When the collet chuck 30 is in a free state, the chucking portion 33 is held open, as shown in FIG. 4A. FIG. 4B shows a condition wherein the bottle 20 has been put in a predetermined position on the bottle holder 21. When the collet chuck 30 is moved away from the bottle 20 by the moving means, the peripheral larger diameter portion of the chuck 30 is pressed by the wall of the hole 31*a* with the result that the chucking portion 33 is squeezed to retain the lug 26 of the lid 25. Subsequently, as shown in FIG. 4C, the chuck 30 moves the lid 25 to a position where the mouth portion 23 of the bottle 20 is fully uncovered, chucking the lug 26 of the lid 25.

The mechanism 32 described above is provided on the toner supply unit 17 and allows the bottle 20 to be mounted to the bottle holder 21 with the mouth portion 23 thereof sealed by the lid 25. Hence, despite that the bottle 20 is set on the bottle holder 21 in a substantially horizontal position, as shown in FIGS. 1A and 1B, the toner is prevented from falling from the mouth portion 23.

When the toner in the bottle 20 is entirely consumed, the empty bottle 20 is taken out of the bottle holder 21. At this instant, the moving means may move the collet chuck 30 toward the bottle 20 to fit the lid 25 in the mouth portion 23. Then, when the bottle 20 is removed from the bottle holder 21, the mouth portion 23 will have been closed by the lid 25. This prevents the toner deposited on the mouth portion 23 from falling and smearing the hands and clothes of the person replacing the bottle 20.

Figure 5A:
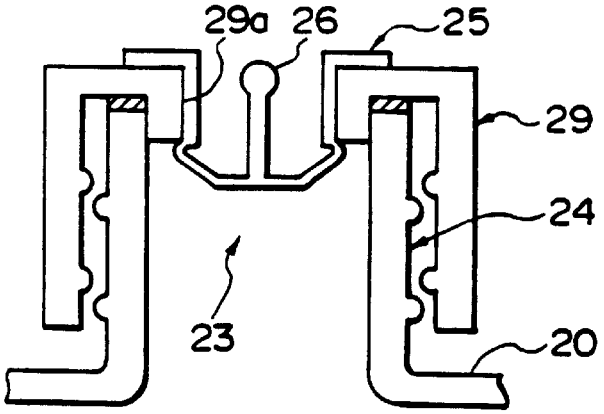
FIG. 5A is a section showing a specific configuration of the lid.

FIG. 5A shows a modified form of the mouth portion 23 of the bottle 20. As shown, the cap, e.g., screw cap 29 to be fitted on the color 24 of the mouth portion 23 is formed with a hole 29*a* in the end wall thereof. The lid 25 having the lug 26 is removably received in the hole 29*a* of the cap 29.

Figure 5B:
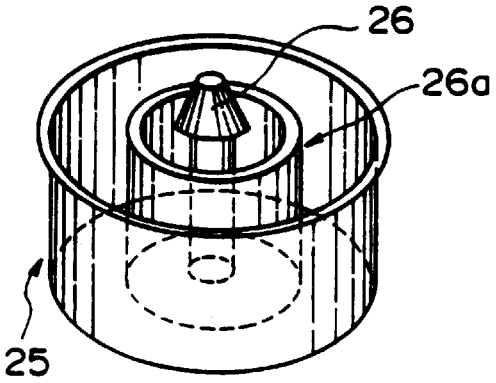
FIGS. 5B and 5C are perspective views each showing another specific configuration of the lid.
Figure 5C:
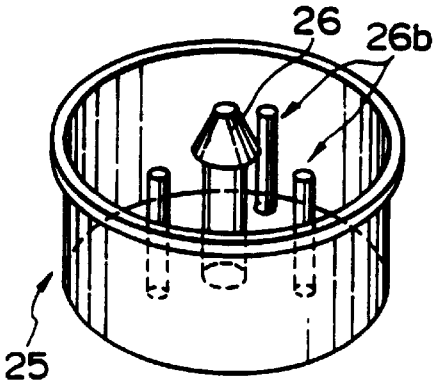

FIGS. 5B and 5C each shows a modification of the lid 25 shown in FIG. 3B or 5A. It is likely that an inexperienced person intends to remove the lid 25 of a new toner bottle 20 by nipping the lug 26 of the lid 25 without using the collet chuck 30. This is apt to cause a fresh toner from falling from the bottle 20. To eliminate this, the lids 25 shown in FIGS. 5B and 5C are each provided with an annular obstruction 26*a* or pin-like obstructions 26*b* around the lug 26. The obstructions 26*a* and 26*b* prevent the easy access of the person's fingers to the lug 26.

Figure 5D:
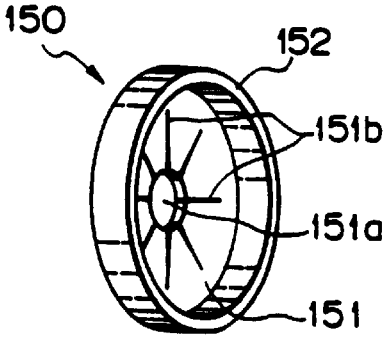
FIG. 5D is a perspective view showing a thin flat piece to be attached to the lid of the toner bottle.
Figure 5E:
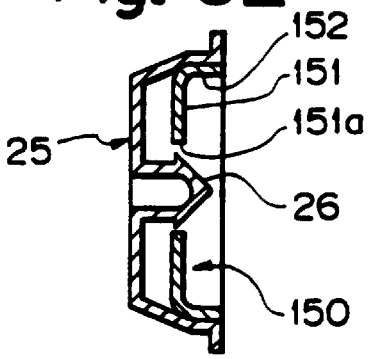
FIG. 5E is a section showing the lid with the thin flat piece attached thereto.

FIG. 5D shows a cover 150 which is a specific substitute for the obstruction 26*a* or obstructions 26*b*. As shown, the cover 150 is made up of a thin flat piece 151 for concealing the portion of the lid 25 surrounding the lug 26, and an annular wall 152 extending out from the outer edge of the thin piece 151. A hole 151*a* is formed in the center of the piece 151 and slightly greater in diameter than the lug 26 of the lid 25. A number of slits 151*b* extend radially from the edge of the hole 151*a*. As shown in FIG. 5E, when the cover 150 is fitted on the lid 25, only the tip of the lug 26 is visible. This prevents even an inexperienced person from mistaking the tip of the lug 26 for a member for removing the lid 25.

Figure 6:
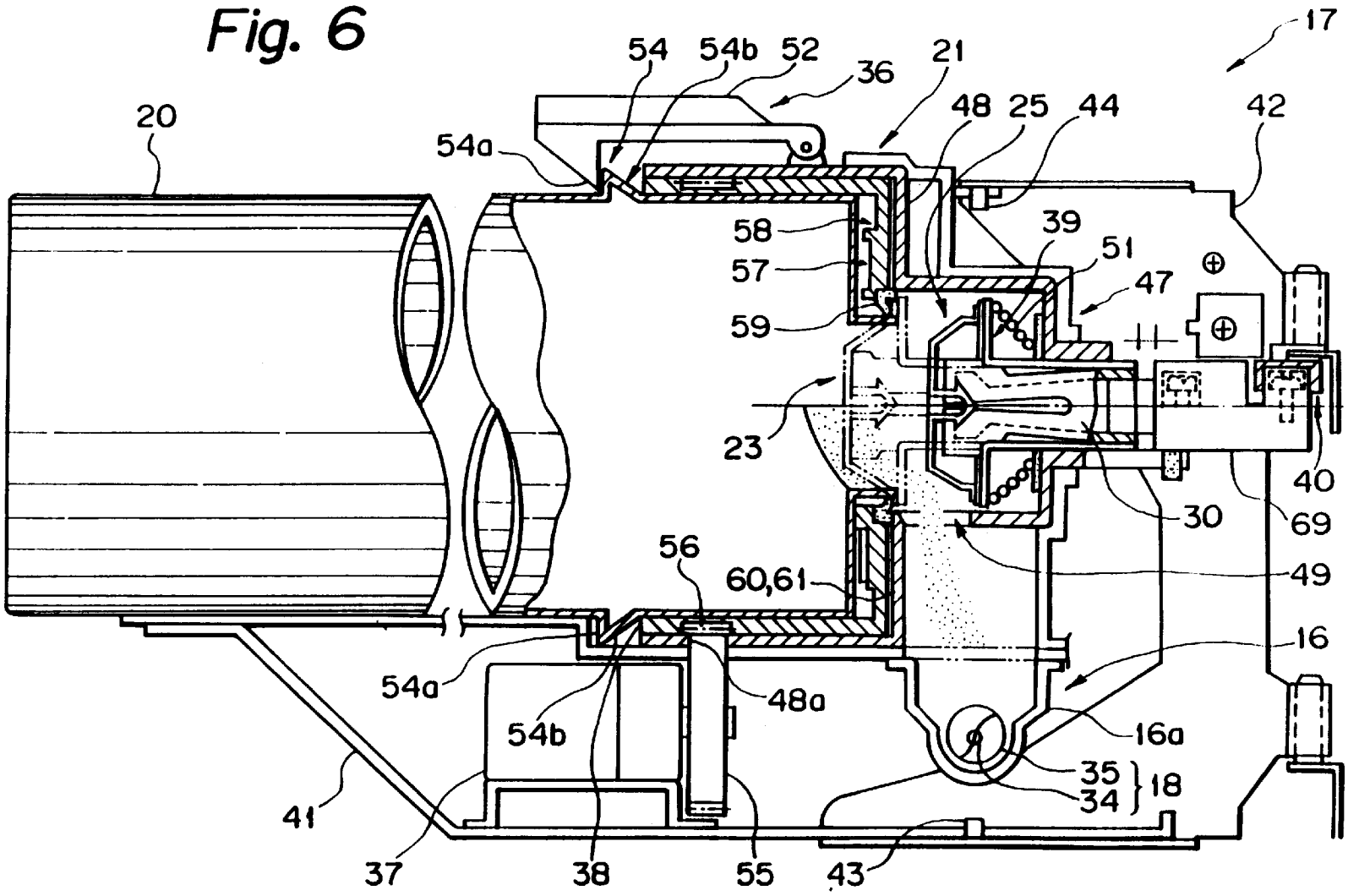
FIG. 6 is a section showing a toner supply unit included in an embodiment of the present invention.
Figure 7:
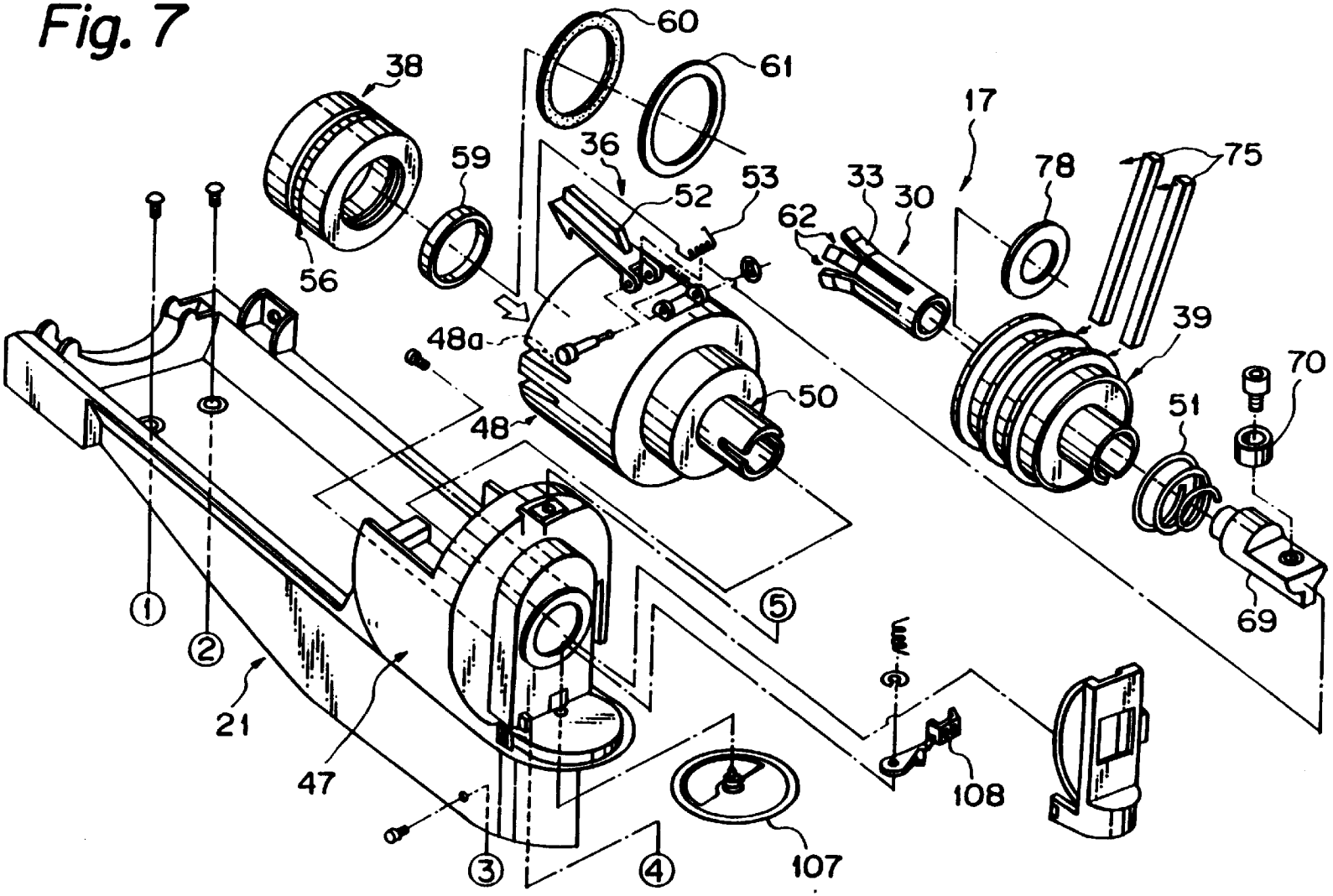
FIGS. 7 and 8 are exploded perspective views each showing a particular part of the toner supply unit.
Figure 8:
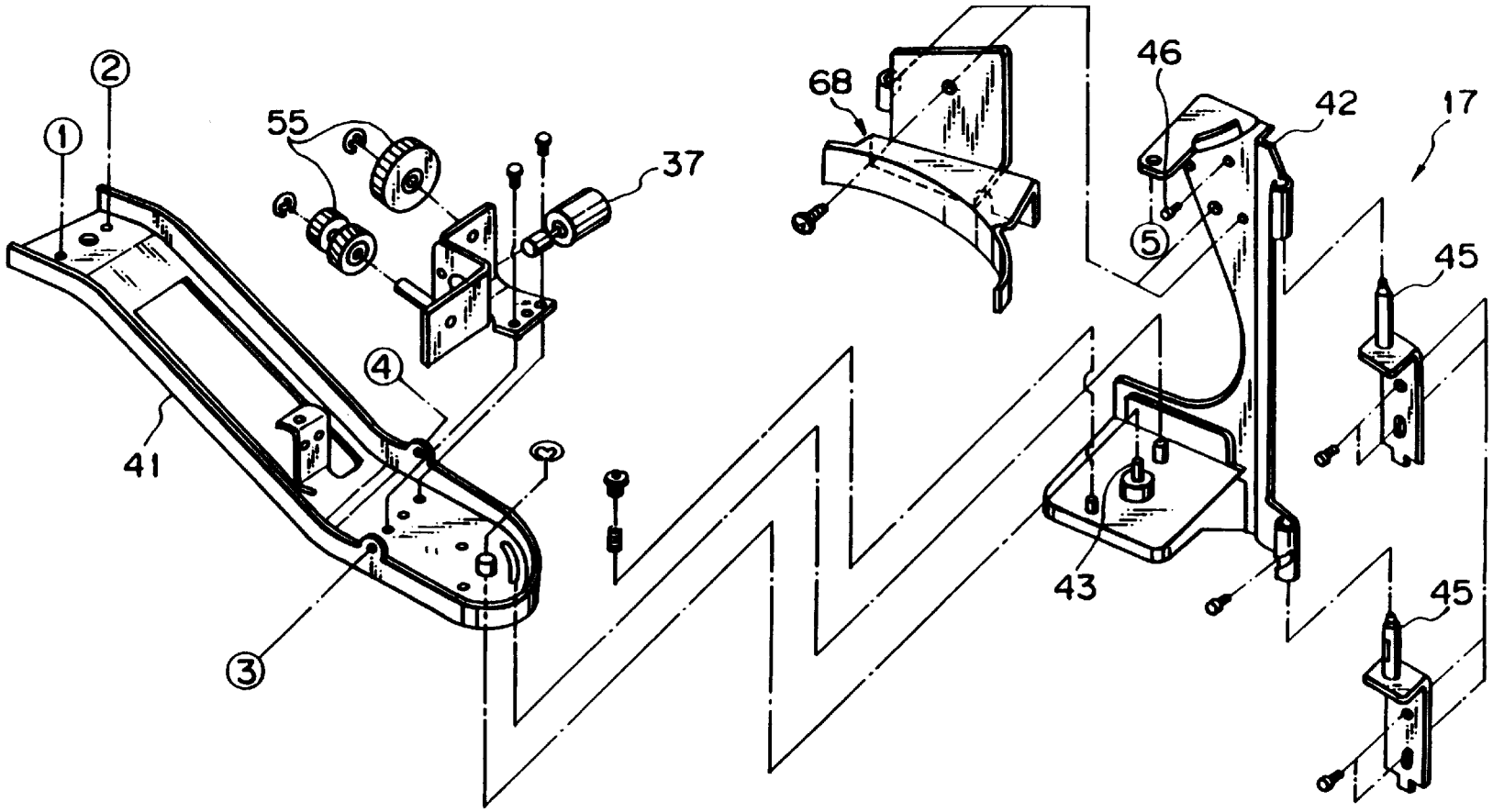

The toner supply unit 17 will be described more specifically. FIG. 6 shows the unit 17 held in the position B while FIGS. 7 and 8 shows it including some modified parts. The unit 17 is so constructed as to hold the bottle 20 and rotate it in synchronism with the rotation of the toner supply roller 19. As a result, a fresh toner is sequentially supplemented to the toner receiving portion 16*a* of the hopper 16 via the mouth portion 23 of the bottle 20.

As shown in FIG. 6, the toner receiving portion 16*a* is implemented as a top-open trough and extends to the front from a side wall of the hopper 16 located at the operating side. A shaft 34 extends from the inside of the hopper 16 and extends throughout the center of the toner receiving portion 16*a*. A spiral member, or toner feed plate, 35 is affixed to the shaft 34 for conveying the toner dropped from the mouth portion 23 of the bottle 20 to the hopper 16. The shaft 34 and spiral member 35 constitute the previously mentioned screw conveyor 18, FIG. 2. The bottle holder 21 is rotatably supported by the front wall of the copier and capable of holding the bottle 20 in a substantially horizontal position. A locking mechanism 36 positions the bottle 20 on the bottle holder 21 in the axial direction of the bottle 20. A motor 37 causes the bottle 20 set on the bottle holder 21 to rotate about the axis thereof. An annular gear link 38 transmits the rotation of the motor 37 to the bottle 20. The previously stated collet chuck 30 chucks the lid 25 of the bottle 20 held on the bottle holder 21. A core 39 is slidably coupled over the collet chuck 30. A cam device 40 moves the collet chuck 30 toward and away from the bottle 20.

As shown in FIGS. 7 and 8, the bottle holder 21 is mounted on a movable bracket 41. A stationary bracket 42 is affixed to the front wall of the copier and has a lower pin 43 and an upper pin 44. FIG. 6, studded thereon. The movable bracket 41 is rotatably supported by the lower pin 43 and rotatably retained by the upper pin 44. Therefore, the bracket 41 is rotatable about a substantially vertical axis extending through the upper and lower pins 43 and 44. As shown in FIG. 8, the stationary bracket 42 is rotatably supported by stays 45 fastened to the front wall by screws and is affixed to the front wall by screws 46.

The bottle holder 21 further includes a lid-like seat 47 for covering the end of the mouth portion 23 of the bottle 20. A cylindrical stop cover 48 is disposed in the seat 47 to cover the mouth portion 23 of the bottle 20 in an air-tight condition. The stop cover 48 has a link receiving portion rotatably accommodating the gear link 38, and a core receiving portion accommodating the core 39. The core receiving portion has a slightly great inside diameter than the mouth portion 23 of the bottle 20. The stop cover 48 is formed with an opening 49, FIG. 6, in the bottom wall thereof for letting the toner to fall, and a hole and a boss 50 on the end wall thereof for slidably supporting the collet chuck 30. An auger-like spring 51 is also accommodated in the core receiving portion to constantly bias the core 39 toward the bottle 20. The core 39 shown in FIG. 7 is a modification and has an advantage which will be described later. In FIG. 7, the reference numeral 48*a* designates a link stop for stopping an annular link formed at the edge of the open end that faces the bottle 20.

The locking mechanism 36 described above positions the bottle 20 in the axial direction of the bottle 20. The mechanism 36 has a locking member 52 and a spring 53 acting on the locking member 52. The locking member 52 is rotatably supported at the base end thereof by a member included in the bottle holder 21, e.g., the stop cover 48 shown in FIGS. 6 and 7. The free end of the locking member 52 is so shaped as to mate with an engaging portion, i.e., a projection or recess formed in the outer periphery of the bottle 20. The spring 53 constantly biases the locking member 52 toward the outer periphery of the bottle 20. In the configuration shown in FIG. 6, the engaging portion of the bottle 20 is implemented as a ring 54 having a right-angled triangular cross-section defined by a substantially vertical contact surface 54*a* and a slant 54*b* extending from the surface 54*a* toward the mouth portion 23. The contact surface 54*a* may be overhung in such a manner as to incline toward the rear end of the bottle 20.

As shown in FIG. 6 or 8, the motor 37 for driving the bottle 20 may be mounted on the movable bracket 41 together with a gear 55. Alternatively, the motor 37 may be affixed to the copier body at a position where it can be engaged with the gear link 38 when the bottle holder 21 is brought to the position B.

The gear link 38 is formed with gear teeth 56 meshing with the gear 55 associated with the motor 37 and is provided with an inside diameter greater than the outside diameter of the bottle 20. A hole is formed in the end wall of the gear link 38 to allow the collar 24 of the bottle 20 to extend therethrough. As shown in FIG. 6, the above-mentioned end wall of the gear link 38 is provided with, for example, a plurality of radially extending ribs (referred to as link ribs hereinafter) 58 capable of mating with ribs (referred to as bottle ribs hereinafter) 57 provided on the bottle 20 (see FIG. 34D).

In the specific arrangement shown in FIG. 6, the stop cover 48 is formed with an opening in the lower portion thereof to allow the gear 55 of the motor 37 to mesh with the gear teeth 56 of the gear link 38. An annular seal 59 is fitted around the hole of the previously mentioned end wall to seal the gap between the outer periphery of the collar 24 of the bottle 20 and the stop cover 48, thereby preventing the toner coming out of the mouth portion 23 from depositing on, for example, the outer periphery of the bottle 20. At the same time, the seal 59 cleans the outer periphery of the collar 24 when the bottle 20 is replaced with a new toner bottle. The seal 59 is so bent as to be convex toward the collet chuck 30, so that the bottle 20 can be set with ease.

There are also shown in FIG. 7 a seal 60 made of sponge or similar soft material and adhered to the end of the gear link 38, a flexible thin seal (e.g. 0.188 mm thick) 61 adhered to the same end over the seal 60, and a shutter 107 for closing the opening which is formed in the seat 47 of the bottle holder 21 for letting the toner to fall. Usually, the shutter 107 is held in a position where an opening formed therein is aligned with the opening of the seat 47. In the event of maintenance, a serviceman may rotate the shutter 107 by holding a thumb piece 108 in order to close the opening of the seat 47.

Figure 9A:
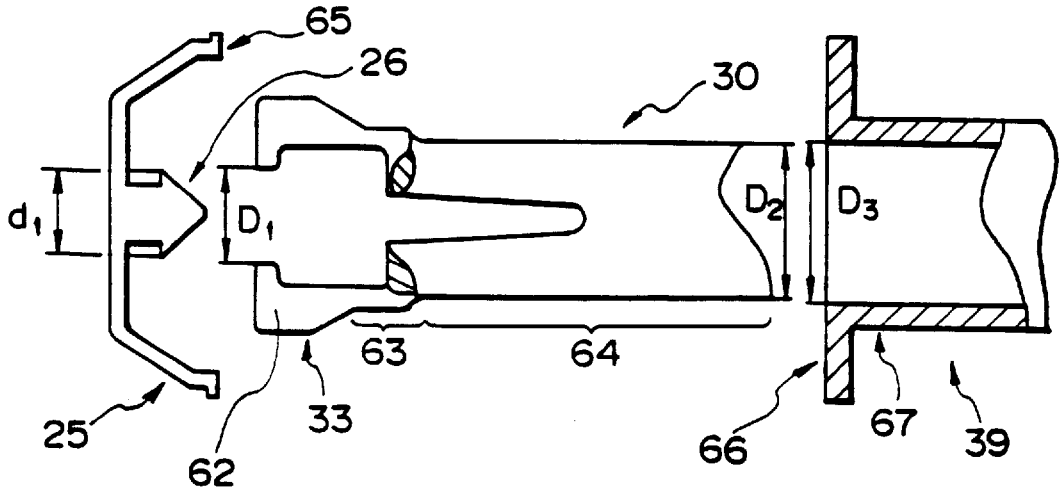
FIG. 9A, 9B, 10A, 10B, 11A and 11B are sections each showing a collet chuck included in the toner supply unit.

As shown in FIG. 7, the collet chuck 30 is formed with a plurality of slits 62 to have the chucking portion 33 thereof squeezed by an external force. In the illustrative embodiment, as shown in FIG. 9A, in an unstressed position, the chucking portion 33 is open over a distance $D_1$ greater than the the maximum diameter $d_1$ of the tip of the lug 26 of the lid 25. The chuck 30 includes a larger diameter portion 63 adjoining the chucking portion 33, and a smaller diameter portion 64 following the larger diameter portion 63. In an unstressed position, the larger diameter portion 63 has an outside diameter greater than the outside diameter $D_2$ of the smaller diameter portion 64.

Figure 9B:
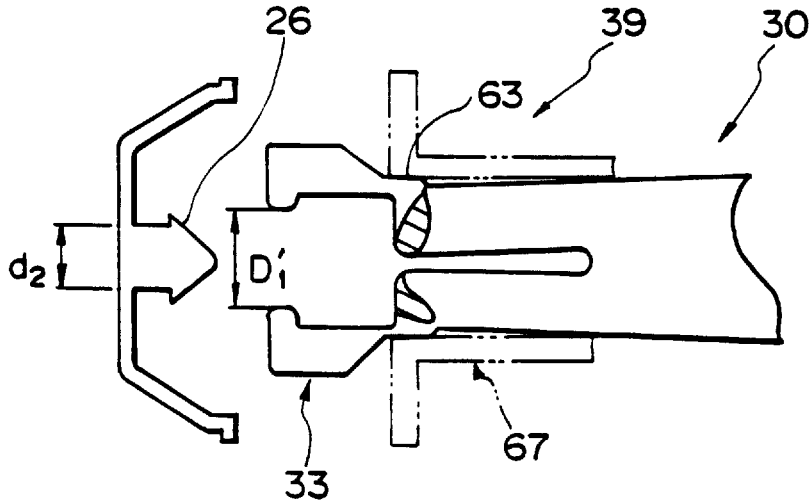

The core 39 is made up of a flange 66 capable of abutting against a flange 65 provided on the lid 25, and a cylindrical slider 67 on and along which the chuck 30 is slidable. The slider 67 has an inside diameter $D_3$ greater than the outside diameter $D_2$ of the smaller diameter portion 64 of the chuck 30 and smaller than the outside diameter of the larger diameter portion 63 when the portion 63 is not stressed. In this configuration, when the core 39 is brought to the larger diameter portion 63 of the chuck 30, the former runs onto the latter to reduce the opening of the chucking portion 33, as indicated by a dash-and-dots line in FIG. 9B.

The resulting opening $D_1$ of the chucking portion 33 is selected to be at least smaller than the maximum diameter $d_1$ of the lug 26 and, preferably, equal to the diameter $d_2$ of the root of the lug 26.

The cam device 40 shown in FIG. 6 is constructed as follows. When the bottle holder 21 is moved from the position B to the position A, the cam device 40 moves the chuck 30 away from the bottle 20. Also, when the bottle holder 21 is moved from the position A to the position B, the cam device 40 moves the chuck 30 toward the bottle 20. In the illustrative embodiment, the cam device 40 has a flat cam member 68 and a roller 70 which is rotatably mounted on a chuck shaft 69. The chuck shaft 69 is affixed to the rear end of the chuck 30.

Figure 10A:
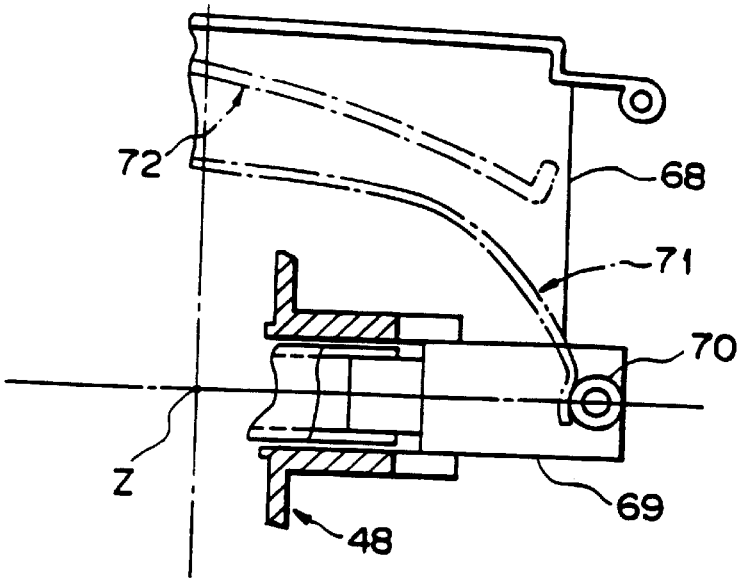
Figure 10B:
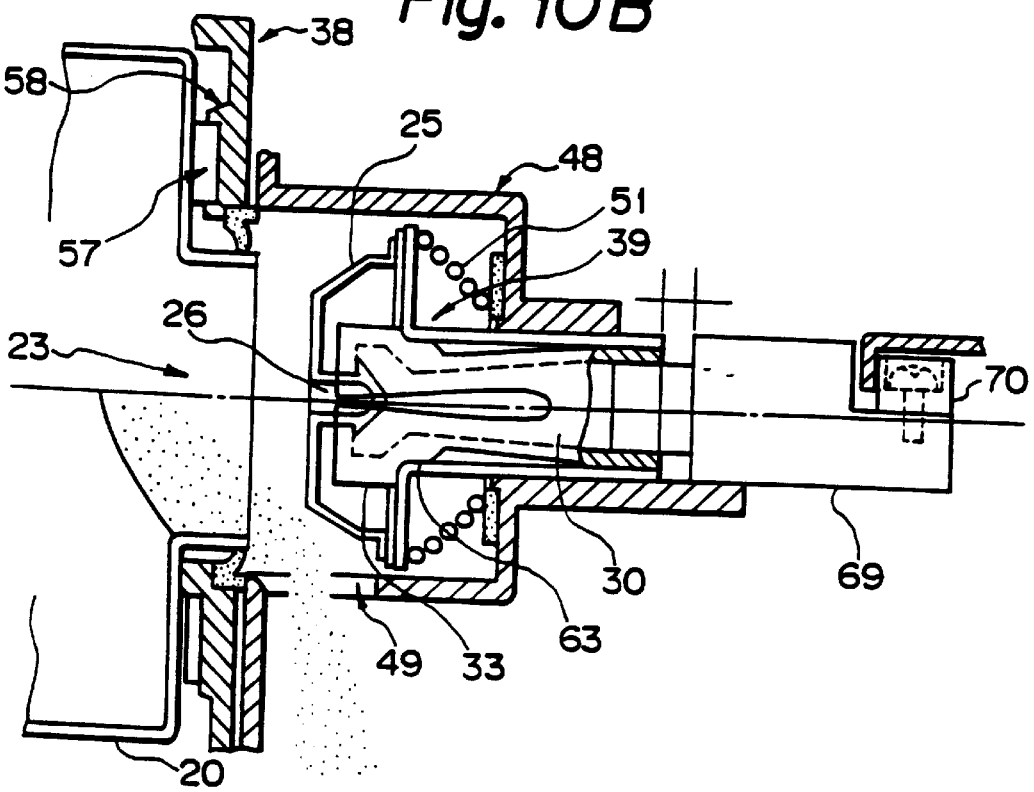

As shown in FIGS. 10A and 10B, the cam member 68 has a first surface 71 for guiding the roller 70 from the side adjoining the center of rotation Z of the bottle holder 21 is located, and a second surface 72 for guiding it from the side opposite to the center of rotation Z. As shown in FIG. 10B specifically, when the bottle holder 21 is moved from the position B to the position A, the first surface 71 guides the roller 70 such that the chuck 30 biased toward the bottle 20 by the spring 51 via the core 39, which is engaged with the larger diameter portion 63 of the chuck 30, moves away from the bottle 20. When the bottle holder 21 is moved from the position A to the position B, the first surface 71 guides the roller 70 such that the chuck 30 biased by the spring 51 moves toward the bottle 20.

Figure 11A:
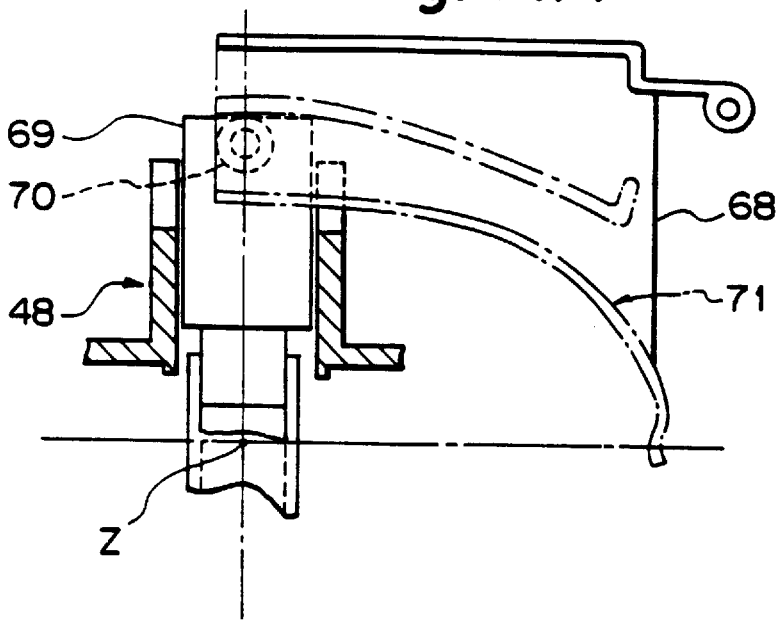
Figure 11B:
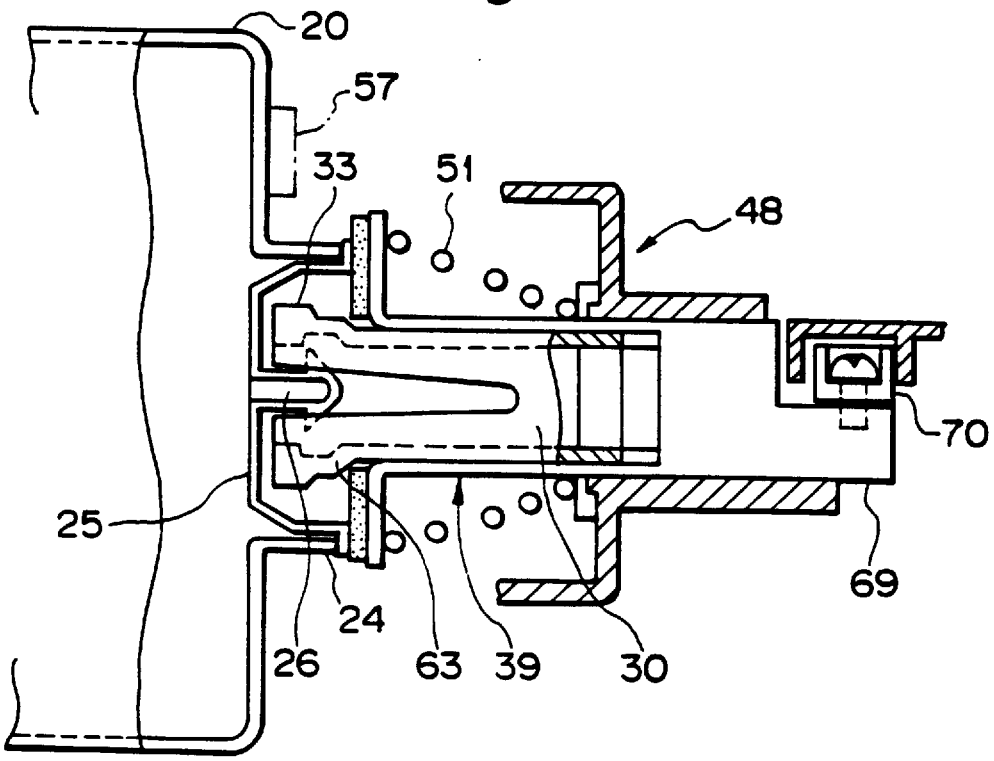

As shown in FIG. 11B specifically, just before the movement of the bottle holder 21 from the position A to the position B completes, the core 39 abuts against the edge of the collar 24 of the bottle 20 positioned by the locking mechanism 36. As a result, the core 39 is released from the larger diameter portion 63 of the chuck 30, preventing the force of the spring 51 from acting on the chuck 30. From this instant to the instant when the movement of the bottle holder 21 to the position B completes, the second surface 72 of the cam member 68 guides the roller 70 such that the 30 approaches the bottle 20.

The cam device 40 is located in the vicinity of the axis of rotation of the bottle holder 21, as stated above. Hence, when the person intending to replace the bottle 20 pulls or pushes the bottle holder 21 between the positions A and B, the point of the holder 21 where the resulting force acts and the center of rotation Z are spaced apart a greater distance than the engaging point of the cam 71 or 72 and roller 70 and the center of rotation Z. This allows the bottle holder 21 to be move by a relatively small force, based on leverage.

In the above construction, while an ordinary copying operation is under way, the toner supply unit 17 has the bottle holder 21 thereof located at the position B. To position the bottle holder 21 at the position B, it is preferable that a locking mechanism, e.g., one using a magnet be provided on the front wall of the copier and bottle holder 21. As shown in FIG. 6, in the position B, the bottle 20 set on the bottle holder 21 is positioned with the ring 54 thereof abutted against the end of the locking member 52 of the locking mechanism 36. In this condition, the bottle ribs 57 of the bottle 20 are engaged with the link ribs 58 of the gear link 38. As shown in FIGS. 10A and 10B, the collet chuck 30 assumes a position remotest from the bottle 20. In this position, the core 39 biased by the spring 51 is positioned at the larger diameter portion 63 of the chuck 30 to squeeze the chucking portion 33. As a result, the chucking portion 33 unseals the mouth portion 23 of the bottle 20, chucking the lug 26, i.e., lid 25. The toner receiving portion 16*a*, FIG. 6, of the hopper 16 is disposed below the opening 49 of the stop cover 48.

As the toner concentration in the developing unit decreases due to repeated development, the toner supply roller 19 starts rotating in response to the output signal of a toner concentration sensor, not shown. At the same time, the motor 37 starts rotating. The rotation of the motor 37 is transmitted to the bottle 20 via the gear 55 and gear link 38, thereby causing the bottle 20 to rotate. The spiral guide groove 27 formed in the inner periphery of the bottle 20 sequentially drives the toner toward the mouth portion 23 of the bottle 20 until it falls from the portion 23. The toner dropped from the bottle 20 is received by the toner receiving portion 16*a* of the hopper 16 via the opening 49 of the stop cover 48. Then, the screw conveyor 18 conveys the toner from the toner receiving portion 16*a* to the hopper 16 deeper into the copier. This operation is continued until the toner concentration in the developing unit increases to a predetermined value, i.e., until the toner supply roller 19 stops rotating. Alternatively, the bottle 20 may be rotated at an adequate time when the toner in the hopper 16 decreases.

Figure 12A:
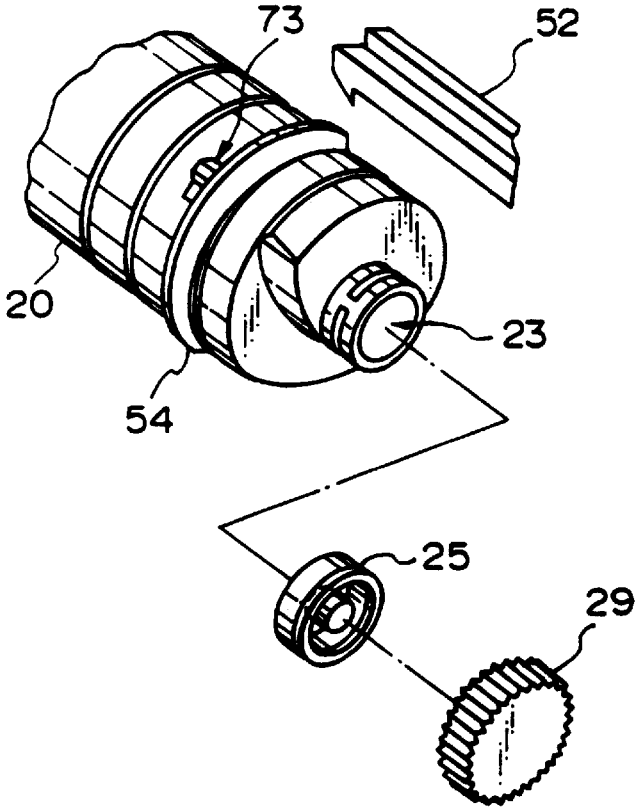
FIG. 12A is an exploded perspective view showing another part of the toner supply unit.
Figure 12B:
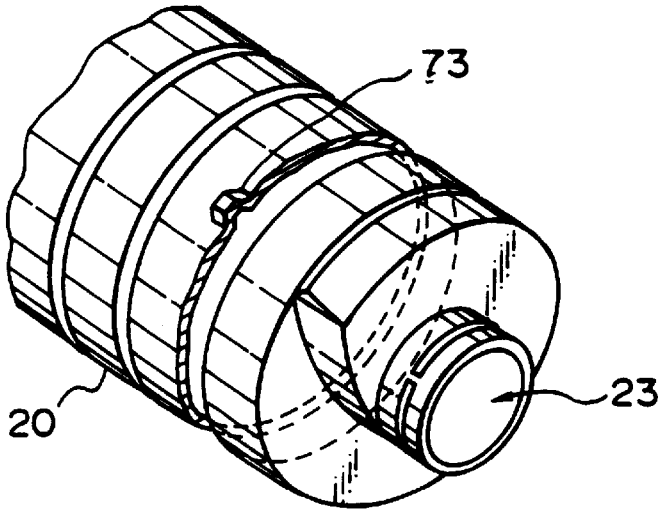
FIG. 12B is a sectional perspective view of the toner bottle.

As shown in FIGS. 12A and 12B, a projection 73 may be provided on the toner bottle 20 at a position where it can face a part of the locking member 52 of the above-described positioning mechanism. Then, when the bottle 20 is rotated, the projection 73 contacts a part of the locking member 52 and raises the free end of the member 52 against the action of the spring 53, FIG. 7, but only to such a degree that the member 52 is not fully released from the ring 54. Subsequently, as the projection 73 moves away from the locking member 52, the member 52 is restored and hits against the outer periphery of the bottle 20, causing the wall of the bottle 20 to vibrate. This is successful in increasing the fluidity of the toner in the bottle 20 and, therefore, causing a greater quantity of toner to flow out of the bottle 20 via the mouth portion 23. In addition, a minimum of toner is caused to adhere to the inner periphery of the bottle 20.

In FIGS. 12A and 12B, the particular configuration of the bottle 20 around the mouth portion 23 promotes the efficient discharge of the toner from the bottle 20, as will be described in detail later.

To remove the bottle 20 from the bottle holder 21 for replacement or similar purpose, the bottle holder 21 is moved from the position B to the position A. While the bottle holder 21 is in movement, the cam device 40 guides the roller 70 with the first surface thereof such that the collet chuck 30 carrying the lid 25 therewith moves toward the mouth portion 23 of the bottle 20. Consequently, the flange 66 of the core 39 abuts against the edge of the collar 24 of the bottle 20 via the flange 65 of the lid 25. Even after the movement of the core 39 has been restricted by the collar 24, the cam device 40 guides the roller 70 with the second surface thereof to continuously move the chuck 30 until the larger diameter portion 63 of the chuck 30 has been released from the core 39. As a result, the chucking portion 33 is opened due to the restoring force of the chuck 30, releasing the lug 26 of the lid 25. By the procedure described so far, the lid 25 is inserted into the collar 24 of the toner bottle 20, thereby sealing the mouth portion 23. When the bottle holder 21 is fully brought to the position A, the chucking portion 33 of the chuck 30 is open over a distance greater than the maximum diameter $D_1$ of the lug 26 of the lid 25, as shown in FIGS. 9A, 11A and 11B.

Subsequently when the bottle holder 21 is held in the position A, the locking member 52 of the locking mechanism 36 is manually pulled up away from the bottle 20 against the action of the spring 53 until the member 52 has been released from the ring 54 of the bottle 20. Then, the bottle 20 is pulled out from the stop cover 48 and taken out from the bottle holder 21.

Figure 13A:
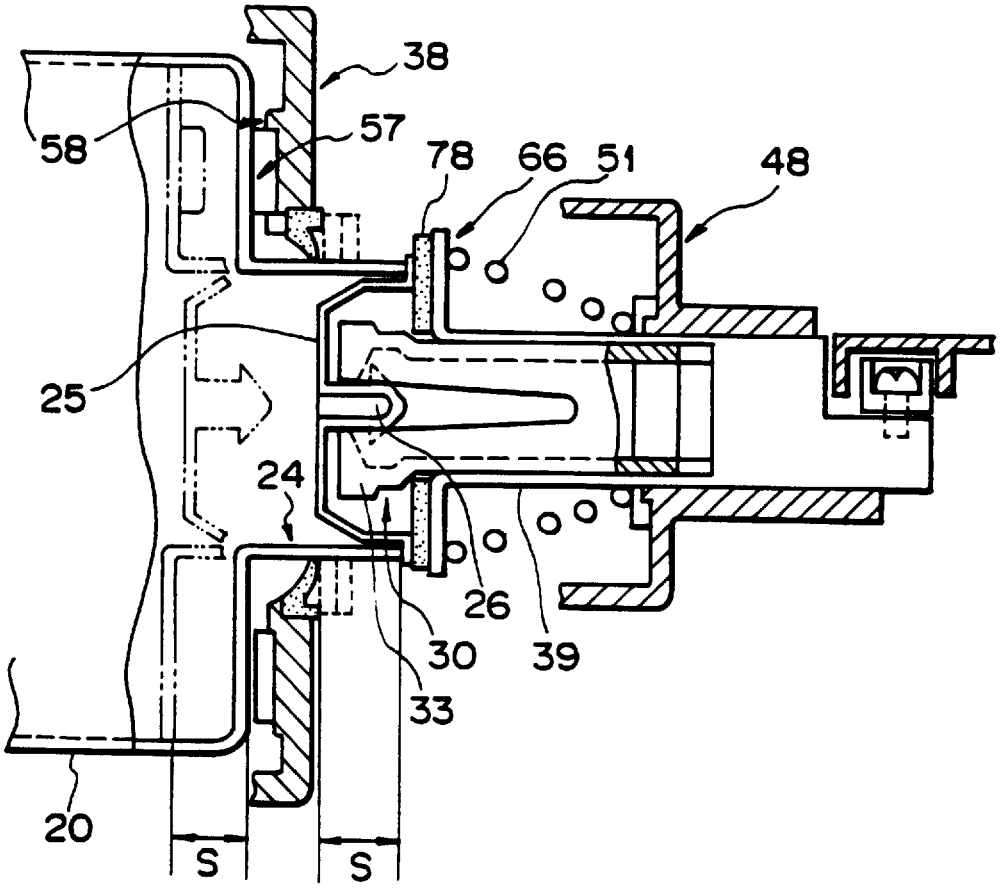
FIG. 13A is a section of the collet chuck.

The locking member 52 is constantly biased toward the bottle 20 by the spring 53. Hence, when the locking member 52 being manually pulled up, as mentioned above, is released, the free end thereof will drop and again mates with the ring 54 of the bottle 20. Therefore, it is necessary to maintain the free end of the locking member 52 in the lifted position in the event when the bottle 20 should be pulled out. To meet this requisite, the bottle 20 should preferably be automatically displaced when the locking member 52 is lifted away from the bottle 20. FIG. 13 shows a specific implementation in which the spring 51 forces out the toner bottle 20 via the core 39 when the bottle 20 is released from the locking mechanism 36. As shown, the height of the collar 24, as well as other factors, is selected such that when the bottle 20 is positioned by the locking mechanism 36, the edge of the collar 24 protrudes a predetermined quantity S from the stop cover 48. In this configuration, at the moment when the locking member 52 is lifted away from the ring 54 of the bottle 20, the core 39 is moved by the spring 51 until the flange 66 thereof hits against the gear link 38. As a result, the bottle 20 is forced out by the predetermined quantity S.

Assume that in the initial state of movement of the core 39 and before the lug 26 of the lid 25 has been fully released from the chucking portion 33 of the collet chuck 30, the core 39 has engaged with the larger diameter portion 63 of the chuck 30 and squeezed the chucking portion 33. Then, the lid 25 is continuously held by the chuck 30, i.e., the mouth portion 23 of the bottle 20 is open even when the bottle 20 is pulled out. As a result, the toner deposited on the inner surface of the mouth portion 23 is apt to fall and smear the hands an cloths. Moreover, when the chucking portion 33 is so squeezed, it is likely that when a new toner bottle 20 is set, the lug 25 of its lid 25 cannot enter the chucking portion 33.

In the light of this, the above-mentioned quantity S should preferably be selected such that even after the flange 66 of the core 39 has abutted against the gear link 38, the core 39 does not contact the larger diameter portion 63 of the chuck 30, thereby maintaining the chucking portion 33 open. Specifically, the gear link 38 should preferably be positioned such that when the bottle 20 is released from the locking mechanism 36, the core 39 abuts against the gear link 38 before it engages with the larger diameter portion 63 of the chuck 30. While the gear link 38 is used to restrict the movement of the core 39, it may be replaced with an exclusive member for restriction.

At the position A, the empty bottle 20 is replaced with a new bottle 20. Specifically, a new bottle 20 is filled with a fresh toner and has the mouth portion 23 thereof sealed by a lid 25. The new bottle 20 is mounted to the bottle holder 21 with the head portion thereof facing the stop cover 48. Then, the head portion of the bottle 20 is inserted into the stop cover 48. At this instant, the locking member 52 of the locking mechanism 36 catches the ring 54 of the bottle 20 being moved into the stop cover 48. As a result, the toner bottle 20 is positioned on the bottle holder 21. In the illustrative embodiment, while the bottle 20 is moved deeper into the stop cover 48, the free end of the locking member 52 runs onto the slant 54*b* of the ring 54. This, coupled with the fact that the ring 54 raises the inclined surface of the member 52, makes it needless to lift the locking member 52 manually.

The core 39 is held in a position where it does not contact the larger diameter portion 63 of the chuck 30 in the stop cover 48, as stated earlier. Hence, the chucking portion 33 of the chuck 30 is left open. It follows that the lug 26 of the lid 25 can be moved into the chucking portion 33 smoothly.

Assume an arrangement wherein when the bottle 20 is forced out by the core 39, as stated previously, the chucking portion 33 of the chuck 30 is closed after the lug 26 of the lid 25 has been released from the chucking portion 33. In such a case, the lid 25 should preferably be configured such that the flange 65 thereof is protruded sufficiently more than the lug 26. Then, when a new bottle 20 is inserted into the stop cover 48, the edge of the collar 24 pushes the flange 66 of the core 39 via such a flange 65 of the lid to release the core 39 from the larger diameter portion 63 of the chuck 30, thereby opening the chucking portion 33. In this condition, the lug 26 of the lid 25 enters the chucking portion 33 which is open then.

Thereafter, the bottle holder 21 is moved from the position A to the position B. At this instant, the cam device 40 guides the roller 70 with the first cam surface thereof such that the chuck 30 carrying the lid 25 therewith moves away from the mouth portion 23 of the bottle 20. In the initial stage of movement, the chuck 30 has the larger diameter portion 63 thereof brought into engagement with the core 39 and has the chucking portion 33 squeezed thereby. As a result, the chucking portion 33 chucks the lug 26 of the lid 25. Even after this, the core 39 and larger diameter portion 63 are continuously engaged by the force of the spring 51, so that the chucking portion 33 holds the lid 25 continuously. Consequently, the lid 25 is removed from the mouth portion 23 to thereby unseal it. In this way, the bottle holder 21 is 5 fully moved to the position B, as shown in FIGS. 6, 10A and 10B. In the position B, a fresh toner is sequentially supplemented from the bottle 20 while the bottle 20 is in rotation.

As stated above, with the toner supply unit 17 of the embodiment, it is possible to replace the bottle 20 simply by moving the bottle holder 21 and then replacing the bottle 20. At this instant, the toner is prevented from leaking from the mouth portion 23 of the bottle 20.

Figure 13B:
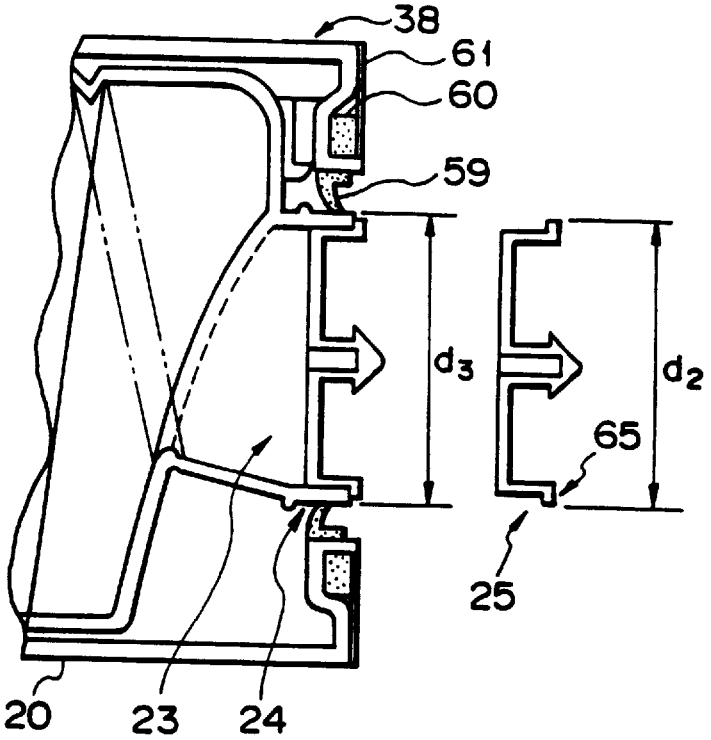
FIGS. 13B and 13C are sections each showing another specific configuration of the toner bottle.
Figure 13C:
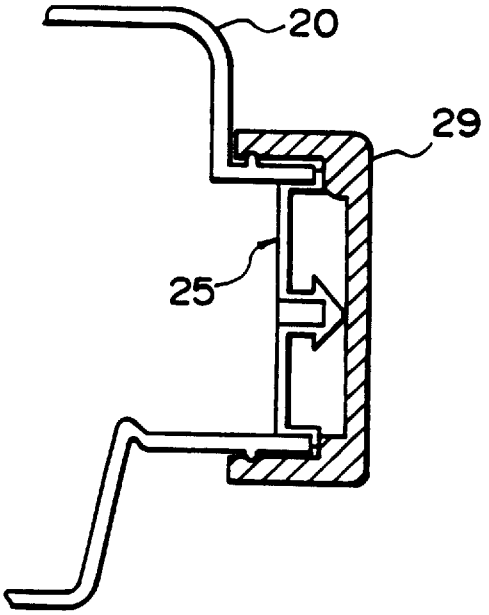

As shown in FIG. 13B, the flange 65 of the lid 25 should preferably be provided with an outside diameter $d_2$ which is smaller than the outside diameter $d_3$ of the collar 24. Otherwise, when the bottle 20 is moved into and out of the stop cover 38, the flange 65 is apt to contact the seal 59 fitted on the inner periphery of the stop cover 38, causing the lid 25 to be removed. Further, as shown in FIG. 13C, the cap 29 is fitted on the bottle 20 over the lid 25. The cap 29 prevents the lid 25 from being accidentally removed from the bottle 20 when the bottle 20 is transported, particularly on highland or by aircraft. In addition, since the cap 29 protects the lid 25, it is not necessary for the lid 25 to be rigidly coupled with the collar 24, reducing the force required of the automatic lid attaching and detaching mechanism.

Figure 14A:
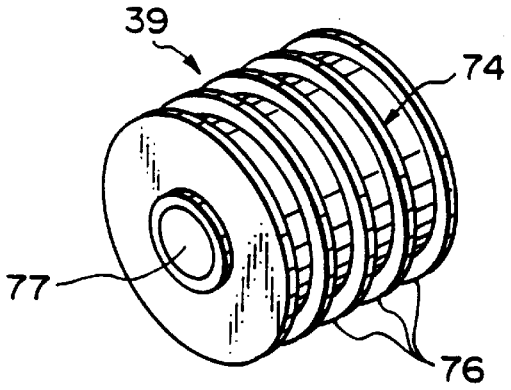
FIGS. 14A–14E are perspective views each showing a specific constituent part included in a core shown in FIG. 7.
Figure 14B:
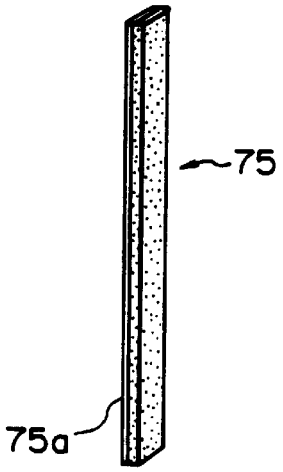
Figure 14C:
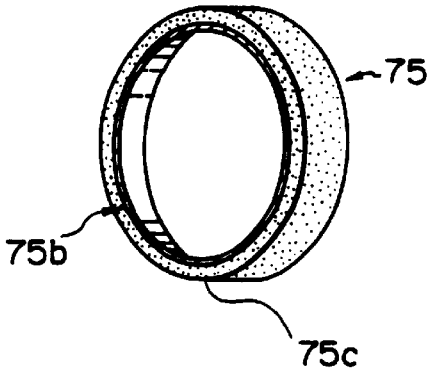

A modified form of the core 39 shown in FIG. 7 will be described with reference to FIGS. 14A–14E. As shown in FIG. 14A, the core 39 has a cylindrical drum portion 74 having a diameter slightly smaller than the inside diameter of the stop cover 48. Flanges are provided on the circumferential surface of the drum portion 74 to form a plurality of annular recesses. Annular seal members 75, FIGS. 14B and 14C, are fitted in the individual annular recesses of the drum portion 74 and arranged side by side in the axial direction of the drum portion 74. The seal members 75 seal the gap between the outer periphery of the core 39 and the inner periphery of the stop cover 48. As shown in FIG. 14B, each seal member 75 may be implemented as an elongate member having an adhesive layer 75*a* and having opposite ends thereof abutted against each other. Alternatively, as shown in FIG. 14C, the seal member 75 may be implemented as a ring and adhered to the drum portion 74. Preferably, the seal members 75 having the configuration shown in FIG. 14B should be positioned such that their portions where opposite ends are abutted are deviated in the axial direction of the core 39. Also, the annular seal member 75 shown in FIG. 14C should preferably be constituted by an elastic member 75*b* enriched in elasticity mainly in the circumferential direction, e.g., a non-foam elastic body, and an elastic body 75*c* provided on the elastic body 75*b* and enriched in elasticity mainly in the direction of thickness, e.g., a foam elastic body.

Figure 14D:
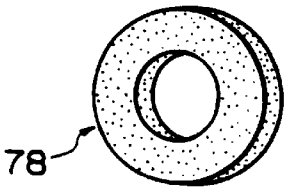
Figure 14E:
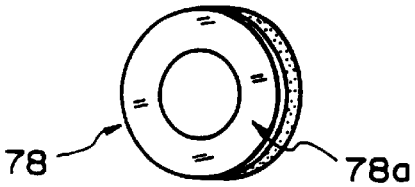

The core 39 shown in FIG. 14A is formed with a boss 77 at the end thereof which abuts against the flange 65 of the lid 25. A hole for the collet chuck 30 to extend is formed throughout the core 39 in the boss 77. The boss 77 also serves to position a flat annular end seal 78 shown in FIG. 14D or 14E when the seal 78 is fitted on the end of the flange by adhesion. The end seal 78 may be implemented by a single material, as shown in FIG. 14D, or by a plurality of annular elements adhered to each other. It is preferable that at least the front end 78*a* of the end seal 78 be constituted by silicone resin, fluorine resin or similar resin having, for example, small surface energy, so that the toner may not deposit thereon easily.

A reference will be made to FIGS. 15–18 for describing an improved implementation for reducing the force to be manually exerted on the bottle holder 21. Assume that the toner is deposited on the inner periphery of the collar 24 of the bottle 20 and the portion of the lid 25 contacting it. Then, the force necessary for the lid 25 to be inserted into and removed from the mouth portion 23 of the bottle 20 is increased. As a result, the force necessary for the bottle holder 21 to be pushed from the position A to the position B (causing the lid 25 to be removed from the mouth 23 portion) and the force necessary for it to be pulled from the position B to the position A (causing the lid 25 to be inserted into the mouth portion 23) are increased.

Figure 15:
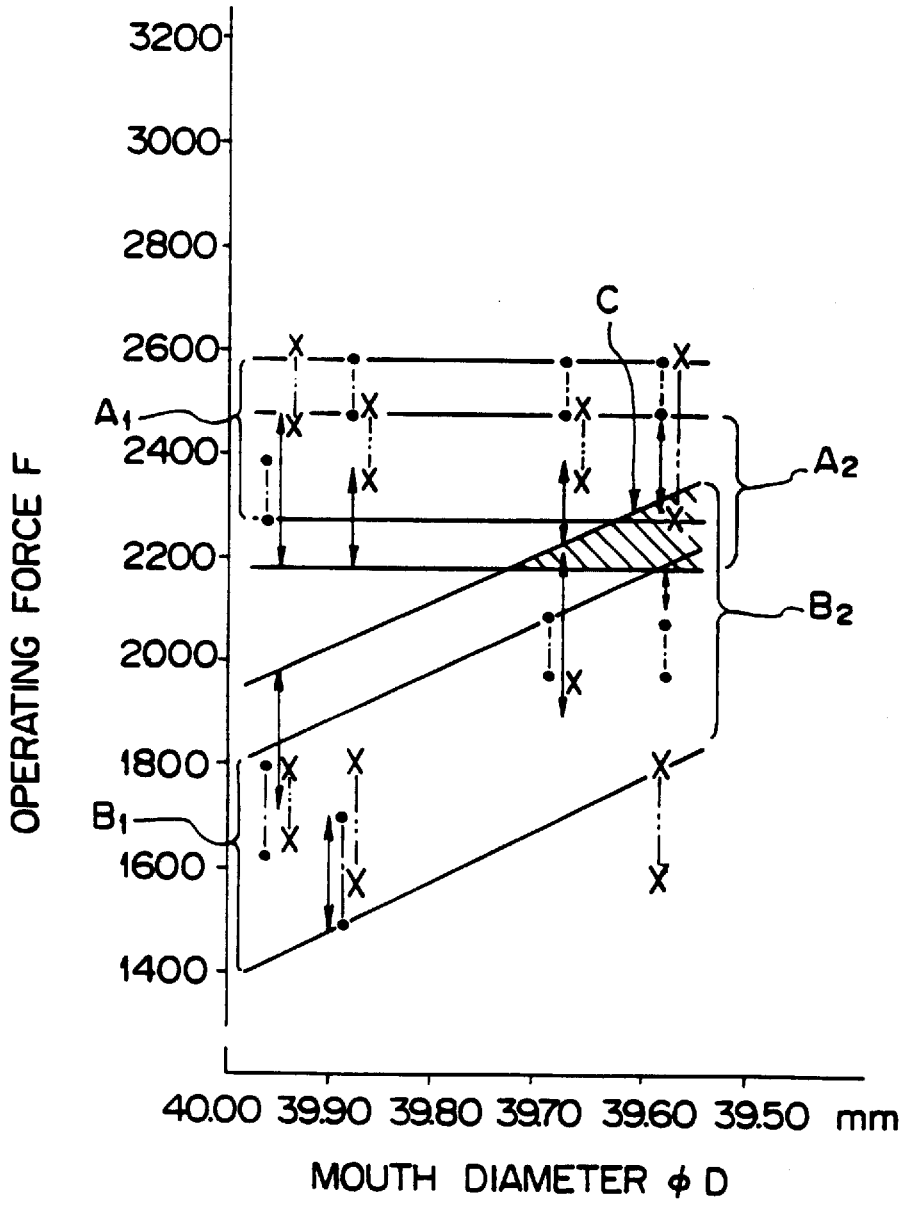
FIG. 15 is a graph indicative of a relation between the force necessary for a person to operate the toner supply unit and the diameter of the mouth of the toner bottle.

The pushing force and pulling force mentioned above were measured with three different types of toner supply units 17 (referred to as types 1 to 3 hereinafter) different in the shape of the collet chuck 30 and that of the core 39, and with toner bottles 20 having various mouth diameters. A toner was deposited on, for example, the inner periphery of the collars 24 of such bottles 20. FIG. 15 is indicative of the results of measurement. In FIG. 15, the abscissa and the ordinate indicate respectively the diameter of the mouth portion 23 of the bottle 20 and the force needed to move the bottle holder 21. The graph includes dash-and-dot lines representative of the results of measurement. Among them, a dash-and-dot line marked with arrows and a dash-and-dot line marked with dots are associated with types 1 and 2, respectively; a dash-and-dot line marked with crosses is associated with type 3. The pushing forces measured with the type 1 are distributed in a region $A_1$ indicated by a brace, while the pulling forces also measured with the type 1 are distributed in a region $B_1$. The pushing forces measured with the type 2 are distributed in a region $A_2$ while the pulling forces measured with the type 2 are distributed in a region $B_2$. Although distributions measured with the type 3 are not shown in the graph, the pushing forces measured lie in the regions $A_1$ and $A_2$ while the pulling forces lie in the regions $B_1$ and $B_2$ and below them. Defective insertion occurred in a region C indicated by hatching (enclosed by a horizontal line representative of a force of 2200 g and an inclined line representative of the upper limit of the region $A_2$).

As FIG. 15 indicates, the required pushing force is greater than the required pulling force and should be, for example, greater than 2 kg. Further, when the pulling force exceeds, for example, 2.2 kg due to the diameter of the mouth portion 23 and the configuration of the collet chuck 30 and core 39, the lid 25 is inserted defectively.

Figure 16:
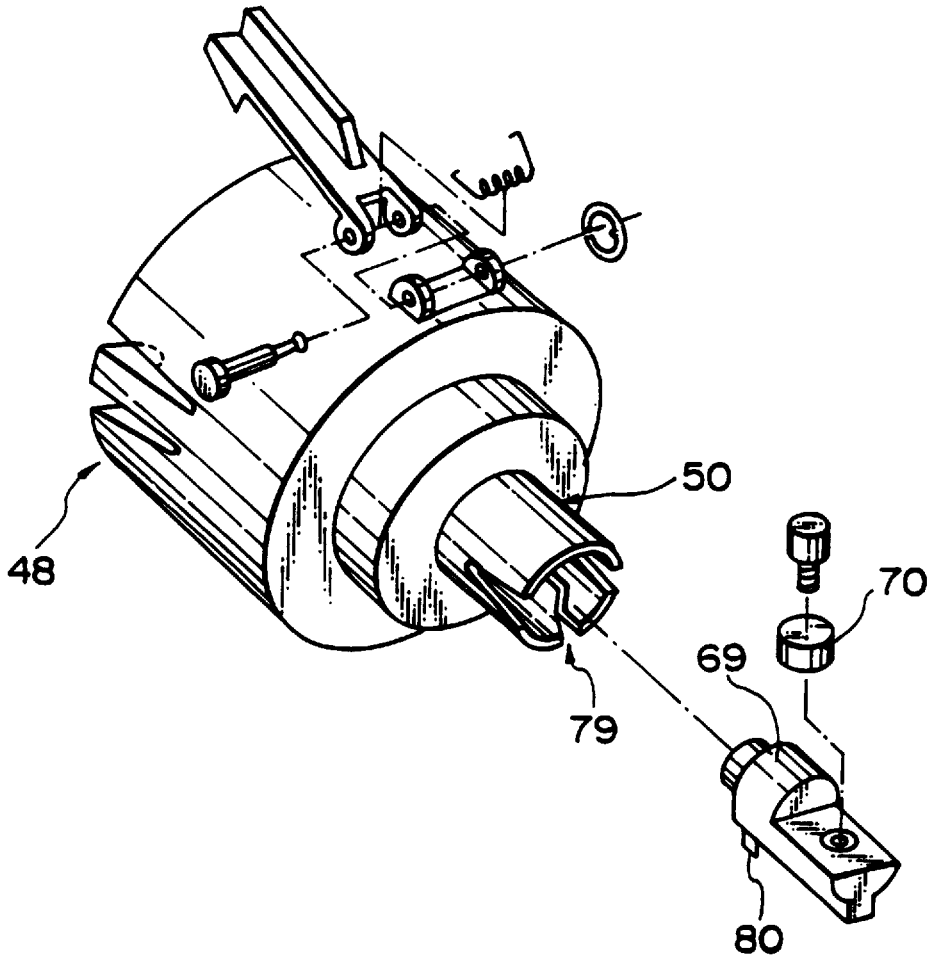
FIG. 16 is a perspective view showing a stop cover and a collet shaft included in a modified embodiment.

FIG. 16 is a fragmentary view of an improved mechanism which causes, when the lid 25 is attached to or detached from the mouth portion 23 of the bottle 20, the lid 25 to rotate about the axis thereof. As a result, the lid 25 is attached to and detached from the mouth portion 23 smoothly, reducing the pushing force and pulling force. To cause the lid 25 to rotate about the axis thereof, the boss 50 of the stop cover 48, in which the chuck 30 slides, is formed with a cam slit 79 for causing the chuck 30 to rotate while moving toward and away from the bottle 20. A pin 80 is studded on the chuck shaft 69 of the chuck 30 and movably received in the cam slit 79.

Figure 17A:
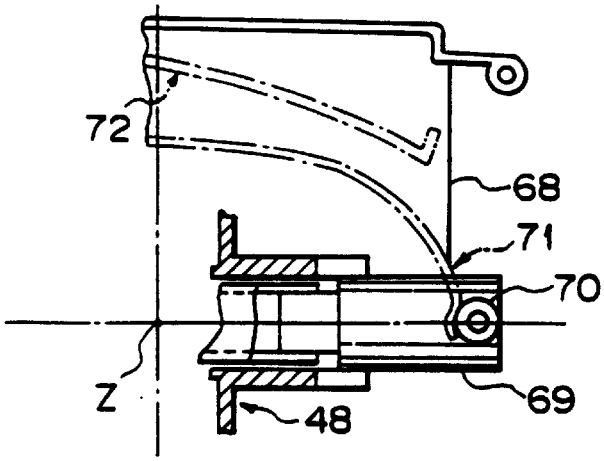
FIGS. 17A–17D demonstrate the operation of the modified embodiment.
Figure 17B:
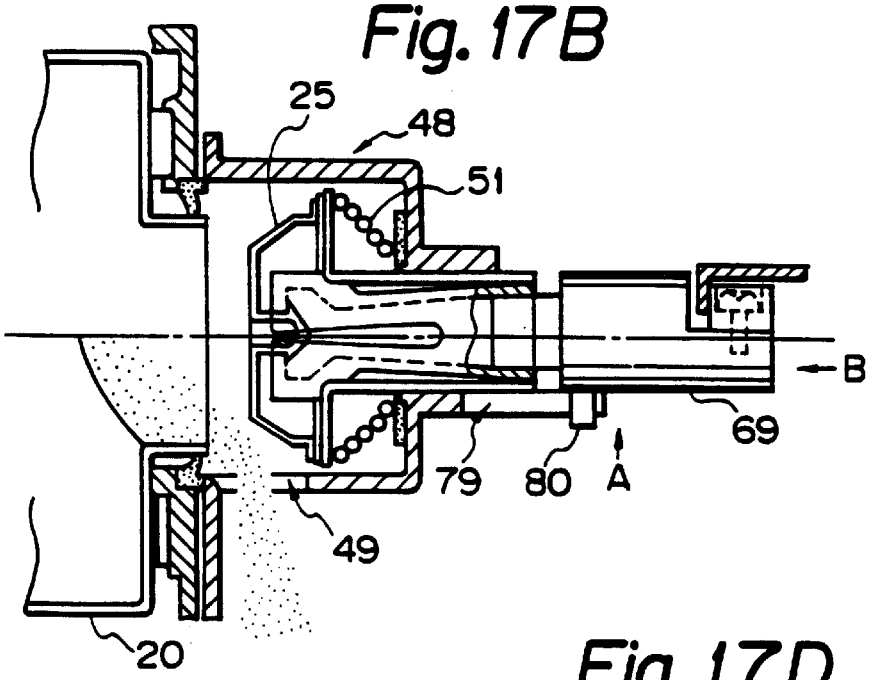
Figure 17C:
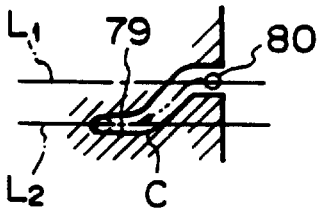
Figure 17D:
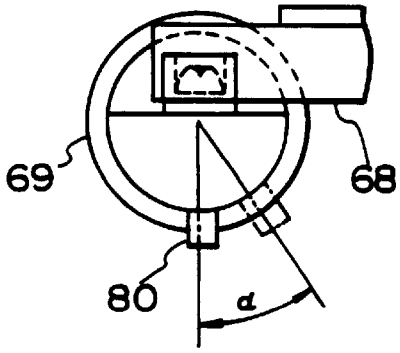
Figure 18A:
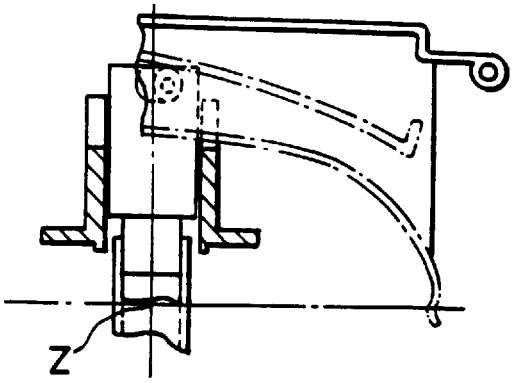
FIGS. 18A–18D show another operation of the modified embodiment.
Figure 18B:
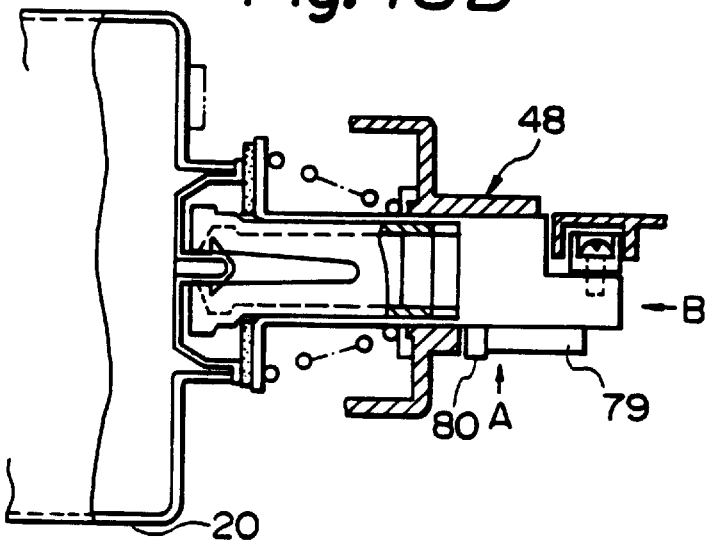
Figure 18C:
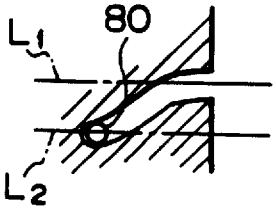
Figure 18D:
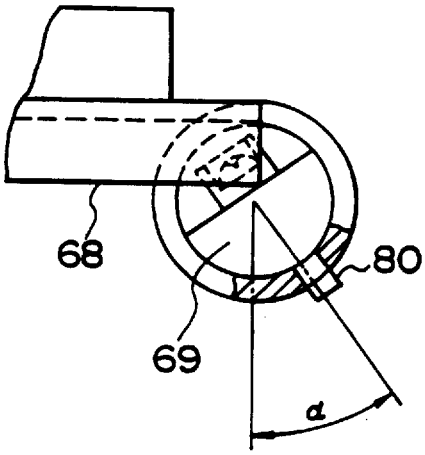

FIGS. 17A and 17B correspond to FIGS. 10A and 10B, respectively, and show the improved mechanism in a condition wherein the bottle holder 21 is located at the position B. FIG. 10C is an enlarged view of the mechanism, as seen in the direction indicated by an arrow A in FIG. 17B. FIG. 17D is an enlarged view of the mechanism, as seen in the direction indicated by an arrow B in FIG. 17B. As shown, the pin 80 is positioned in the outermost portion of the cam slit 79 formed in the circumferential lowermost portion of the boss 50, which is indicated by a dash-and-dot line $L_1$ in FIG. 17C. The innermost end of the cam slit 79 assumes a position indicated by a dash-and-dot line $L_2$, FIG. 10C, which is deviated a predetermined angle $\alpha$, e.g., 90 degrees from the position $L_1$. While the pin 80 moves from the outermost portion to the innermost portion of the cam slit 79, as indicated by a dash-and-dots line C in FIG. 17C, the slit 79 causes the pin 80 to rotate the predetermined angle $\alpha$ about the axis of the boss 50, as indicated by FIG. 17D. FIGS. 18A and 18B correspond to FIGS. 11A and 11B, respectively, and show the mechanism in the condition wherein the bottle holder 21 is located at the position A. FIG. 18C is an enlarged view as seen in the direction indicated by an arrow A in FIG. 18G. FIG. 18D is an enlarged view as seen in the direction indicated by an arrow B in FIG. 18B.

In operation, when the bottle holder 21 is moved from the position B toward the position A, the chuck shaft 69 of the chuck 30 moves toward the toner bottle 20 while sliding within the boss 50 of the stop cover 48. At the same time, the pin 80 rotates the predetermined angle $\alpha$ about the axis of the boss 50 of the stop cover 48 by being guided by the cam slit 79, as indicated by the line C in FIG. 17C. As a result, the lid 25 held by the chuck 30 is sequentially inserted into the collar 24 of the bottle 20 while rotating about the axis of the boss 50.

Conversely, when the bottle holder 21 is moved from the position A toward the position B, the chuck shaft 69 moves away from the bottle 20 while sliding within the boss 50 of the stop cover 48. At this instant, the pin 80 rotates the angle $\alpha$ about the axis of the boss 50 in the opposite direction by being guided by the cam slit 79. Consequently, the lid 25 held by the chuck 30 is removed from the collar 24 of the bottle 20 while rotating about the axis of the boss 50.

As stated above, the lid 25 is inserted and removed from the mouth portion 23 of the bottle 20 while rotating about the axis of the boss 50 of the stop cover 48. This promotes smooth insertion and removal of the lid 25 from the mouth portion 13 and, therefore, reduces the required forces for pushing and pulling the bottle holder 21, compared to the case wherein the lid 25 does not rotate.

Figure 19A:
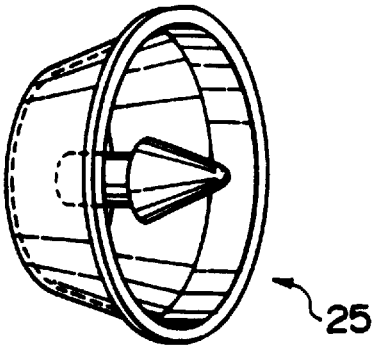
FIG. 19A is a perspective view showing the lid.
Figure 19B:
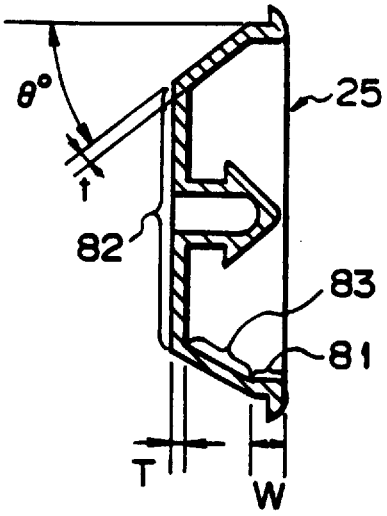
FIG. 19B is a section of the lid shown in FIG. 19A.
Figure 19C:
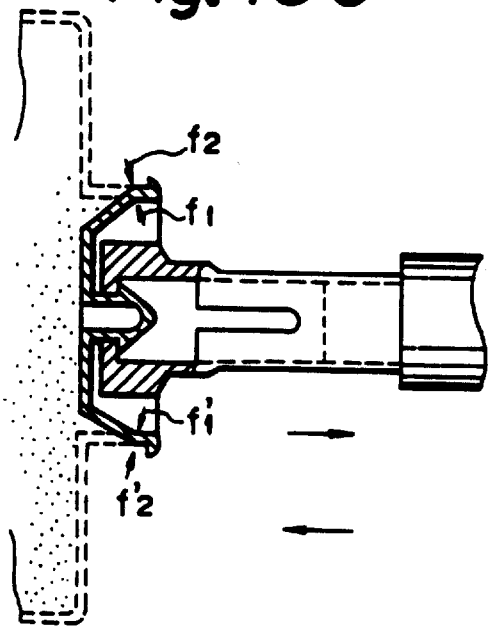
FIG. 19C illustrates forces to act on the lid when the lid is attached and detached.

Another improved mechanism for reducing the forces necessary for the bottle holder 21 to be pushed and pulled will be described with reference to FIGS. 19A–19D. FIGS. 19A and 19B show a specific configuration of the lid 25 which promotes easy attachment and detachment of the lid 25 to the mouth portion 23 of the toner bottle 20. As shown, the lid 25 has an annular wall portion 81 which contacts the inner periphery of the collar 24, a bottom wall portion 82, and an inclined wall portion 83 connecting the two wall portions 81 and 82. The wall portion 83 is inclined a predetermined angle, preferably less than 45 degrees. The bottom wall portion 82 has a diameter smaller than the outside diameter of the annular wall 81.

Preferably, the inclined wall 83 has a thickness t smaller than the thickness T of the bottom wall 82, e.g., one half of the thickness T ($t \approx \frac{1}{2} \cdot T$). As a result, when the collet chuck 30 inserts the lid 25 into the mouth portion 23, the forces $f_1$ and $f'_1$ (see FIG. 19C) necessary for the circumferential wall of the lid 25 to press the collar 24 are reduced, compared to a case wherein the thicknesses t and T are equal. Also, when the chuck 30 pulls out the lid 25 from the mouth 23, the forces $f_2$ and $f'_2$ (see FIG. 19C) exerted by the collar 24 on the circumferential wall of the lid 25 are reduced. This prevents the lid 25 from being inserted in or pulled out from the mouth portion 23 defectively due to the deformation thereof.

If desired, the surface of the bottom wall portion 82 of the lid 25 that contacts the toner may be provided with undulations. Then, although the toner may have aggregated during storage, it can start being discharged easily when the lid 25 is removed. The undulations may be implemented by wavy ribs formed on the above-mentioned surface of the bottom wall portion 82.

Figure 19D:
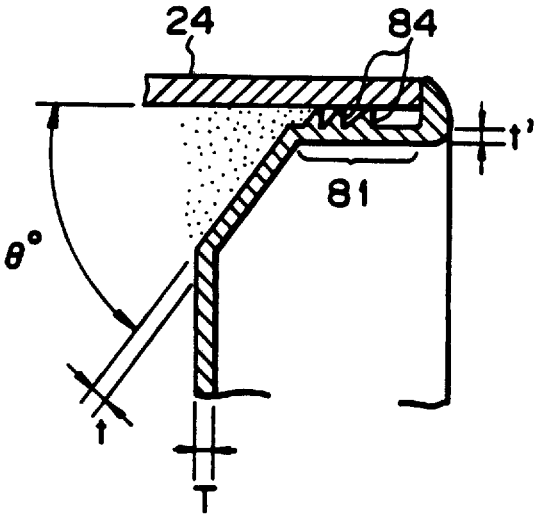
FIG. 19D is a section showing another specific configuration of the lid.

Further, as shown in FIG. 19D, the outer surface of the annular wall portion 81 may be provided with a saw-toothed portion 84. When the lid 25 is inserted into the mouth portion 23, the saw-toothed portion 84 will scrape off the toner deposited on the inner periphery of the collar 24 of the bottle 20 and drive it into the bottle 20. As a result, the force necessary for the lid 25 to be inserted into the collar 24 is maintained constant. This eliminates an occurrence that the force necessary for the lid 25 to be into the mouth portion 23 is increased by 1.5 times due to the toner deposited on the inner surface of the collar 24. For example, a chuck 30 and lid 25 combination could be selected which reduced, when the mouth portion 23 had a diameter of 39.90 mm, the force for pulling the lid 25 to 950 g at maximum when the toner was not deposited and to 1570 g at maximum even when the toner was deposited. Also, such a combination reduced the force necessary for the lid 25 to be inserted to 1370 g at maximum when the toner was not deposited and to 1770 g at maximum when the toner was deposited.

Referring to FIGS. 20A–24C, a specific configuration of a part of the bottle 20 adjacent the mouth portion 23 will be described which allows the toner to be discharged in a desirable manner. In the figures, the bottle ribs 57 to receive a rotating force from the ring are not shown (see FIGS. 34A and 34B).

Figure 21A:
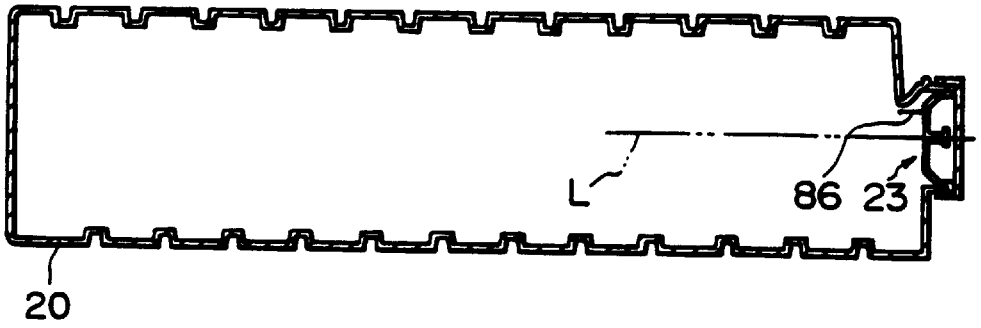
FIG. 21A is a section along line A—A of FIG. 20A.

Briefly, the bottle 20 shown in the figures is configured such that when the bottle 20 is set on the bottle holder 21 in a substantially horizontal position with the mouth portion 23 oriented sideways, the toner existing in the lower portion of the cylindrical body of the bottle 20 is raised to the mouth portion 23 by the rotation of the bottle 20 and then discharged via the mouth portion 23. As a result, the toner is desirably driven out of the bottle 20 via the mouth portion 23 which has a smaller diameter than the cylindrical body of the bottle 20. Specifically, the end or shoulder of the bottle 20, where the mouth portion 23 is provided, has the inner periphery thereof partly raised to the edge of the mouth portion 23 to thereby form a portion 85 indicated by hatching. The raised portion 85 moves the toner upward when the bottle 20 is in rotation, as will be described specifically later. As shown in FIG. 21A, since the end wall and circumferential wall of the bottle 20 have substantially the same thickness, the internal configuration of the bottle 20 directly appears on the outer periphery also. For this reason, in the other figures (e.g. FIG. 20E), the reference numerals attached to the inner periphery of the bottle 20 are also used to designate the corresponding portions of the outer periphery.

Figure 20A:
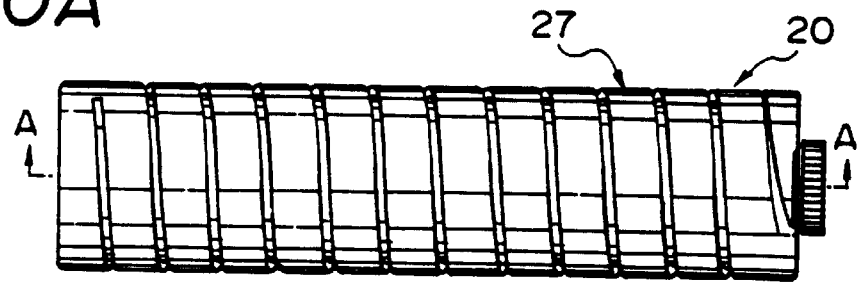
FIG. 20A is a front view of the toner bottle to which a cap is attached.
Figure 20B:
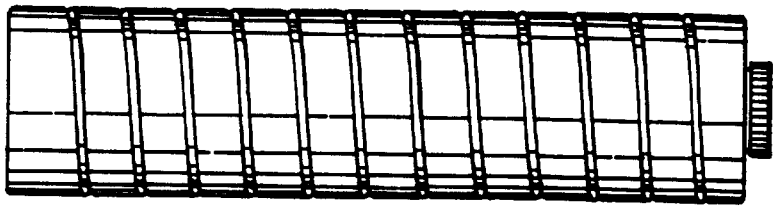
FIGS. 20B–20F each shows the toner bottle of FIG. 20A in a particular view.
Figure 20C:
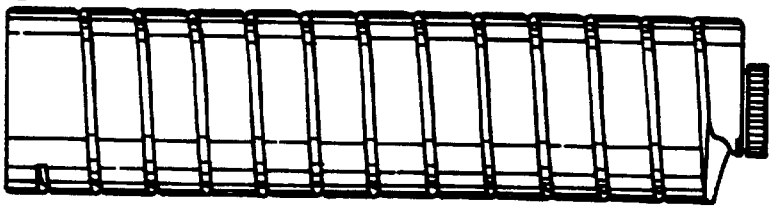
Figure 20D:
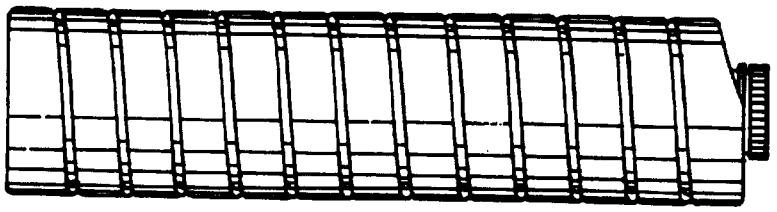
Figure 20E:
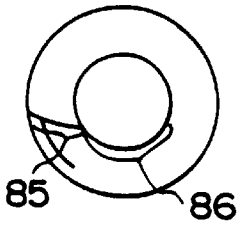
Figure 20F:
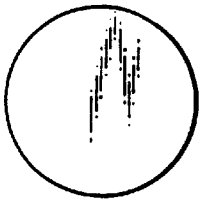
Figure 20G:
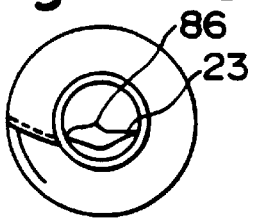
FIG. 20G is a plan view of the toner bottle from which the cap is removed.
Figure 21B:
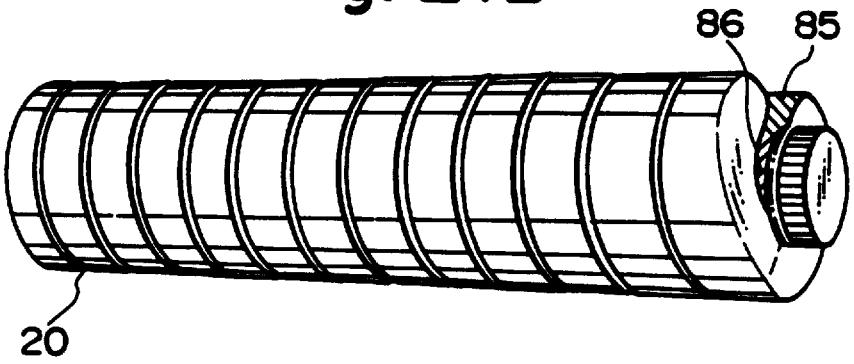
FIG. 21B is a perspective view of the toner bottle.

Further, the bottle 20 has another raised portion 86 contiguous with the raised portion 85 in the circumferential direction, as indicated by hatching different in direction from the hatching indicative of the portion 86 in FIG. 21B. Specifically as shown in FIG. 21A, the inner peripheral portion of the circumferential wall contiguous with the raised portion 85 in the circumferential direction is raised toward the axis, or center line of rotation, L of the bottle 20 over the edge of the mouth portion 23. As shown in FIG. 20G, when the bottle 20 is seen from the outside in the axial direction, i.e., along the center line L with the cap and lid thereof removed, the raised portion 86 appears in the mouth portion 23.

Figure 21C:
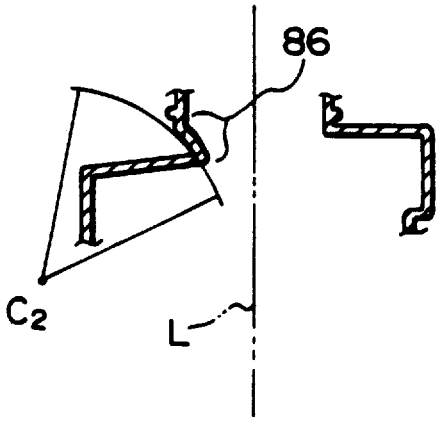
FIG. 21C is an enlarged section of a part of the toner bottle shown in FIG. 1A.
Figure 21D:
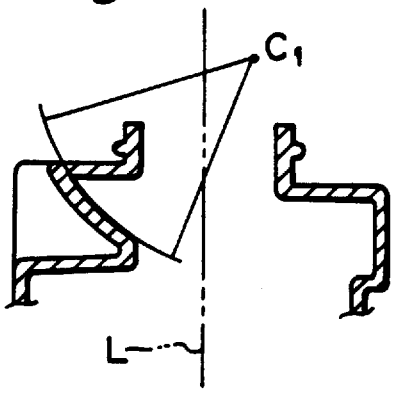
FIG. 21D is a section along line A1–A3 of FIG. 23C.

Preferably, the contiguous raised portions 85 and 86 should be provided with a ramp surface configuration which protrudes more toward the axis L as the distance thereof from the mouth portion 23 increases. Further, as shown in FIG. 21D, it is preferable that the raised portions 85 and 86 be provided with concavity which at least partly appears, in a section containing the axis L, as a curve whose center of curvature $C_1$ is close to the axis L. FIG. 21D is a section along line A4–A2 of FIG. 23C and representative of the raised portion 85. FIG. 21C is a fragmentary enlarged view of FIG. 21A and a section along line A1–A3 of FIG. 23C. As shown in FIG. 21C, the raised portion 86 should preferably have the end portion thereof provided with convexity appearing, in the section containing the axis L, as a curve whose center of curvature $C_2$ is remote from the axis L. The curve with the center of curvature C2 allows the toner to be forced out to the collar 24 smoothly. Moreover, it is preferable that the raised portions 85 be contiguous with the spiral guide groove 27. Then, the toner guided along the guide groove 27, which has a constant width, to the vicinity of the mouth portion 23 will be continuously raised to the edge of the mouth portion 23 and then guided to the raised portion 86.

Figure 24B:
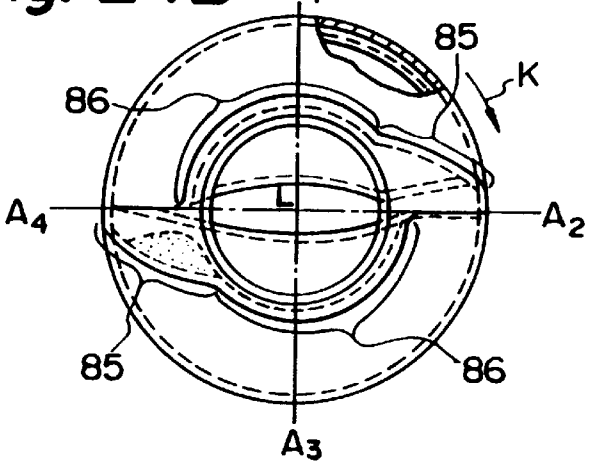
FIGS. 24A–24C each shows a modified form of the toner bottle in a particular view.
Figure 24A:
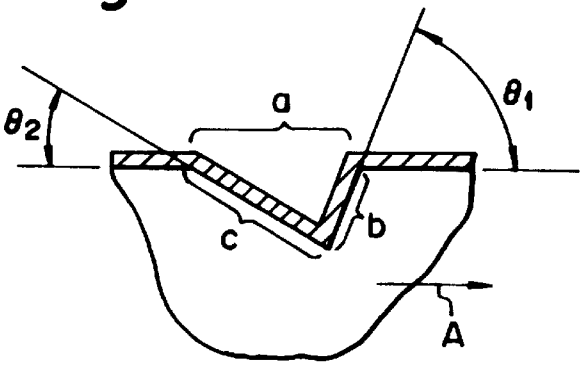

FIG. 24A shows a preferred configuration of a wall a forming the guide groove 27 of the bottle 20. As shown, the wall a includes a portion b for driving the toner in the guiding direction indicated by an arrow A (i.e. toward the mouth portion 23). The portion b protrudes toward the axis of the bottle 20 at an angle θ1 substantially perpendicular to the flat inner periphery of the bottle 20, e.g., 80 degrees to 90 degrees. The other portion c of the wall a, which the toner being conveyed gets over, protrudes toward the axis of the bottle 20 at a small angle θ2, e.g., less than 30 degrees, preferably 10 degrees to 30 degrees and in the guiding direction A. The wall a with such a configuration causes the toner to fall from the inner periphery thereof easily while the bottle 21 is in rotation, thereby allowing a minimum of toner to remain in the bottle 20.

Figure 22C:
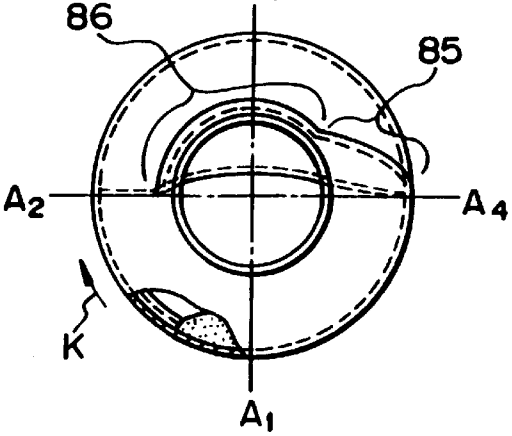
FIG. 22C is a side elevation of the toner bottle shown in FIG. 22A, as seen from the right.
Figure 22D:
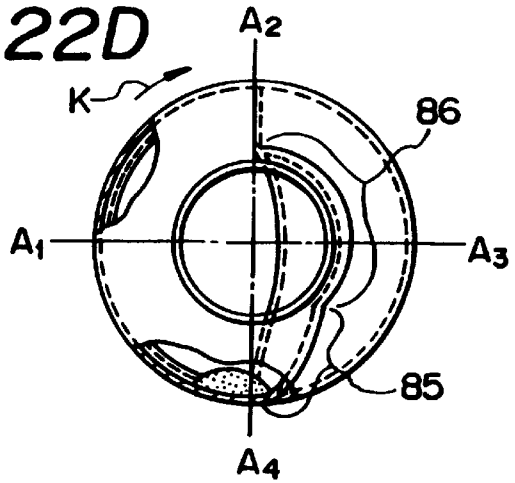
FIG. 22D is a side elevation of the toner bottle shown in FIG. 22B, as seen from the right.

How the raised portions 85 and 86 guide the toner will be described with reference to FIGS. 22A–22D and 23A–23D. FIGS. 22C and 23C are side elevations, as viewed from the right, of the bottle 20 shown in front views in FIGS. 22A and 23A, respectively. FIGS. 22D and 23D are side elevations, as viewed from the right, of the bottle 20 shown in front views in FIGS. 22B and 23B, respectively. It is to be noted that FIGS. 22B and 23B show the bottle 20 in a position rotated 90 degrees from the position shown in FIGS. 22A and 23A. The arrow K is indicative of the direction in which the bottle 20 is rotated by the toner supply unit 17.

Figure 22A:
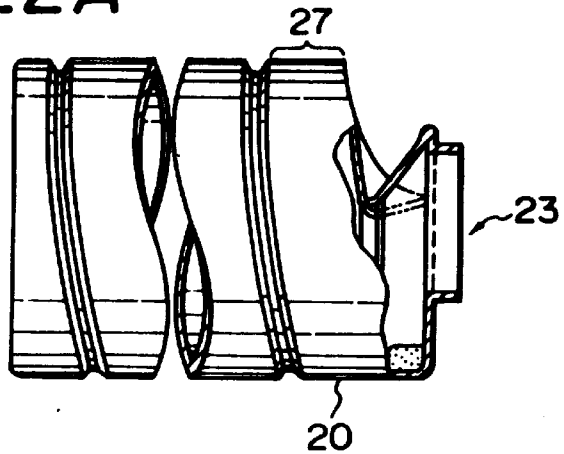
FIG. 22A is a front view demonstrating how the toner bottle guides a toner with raised portions thereof.
Figure 22B:
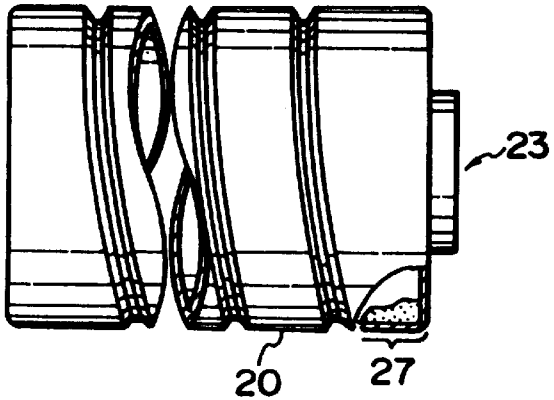
FIG. 22B is a front view of the toner bottle rotated 90 degrees from the position of FIG. 22A.
Figure 23A:
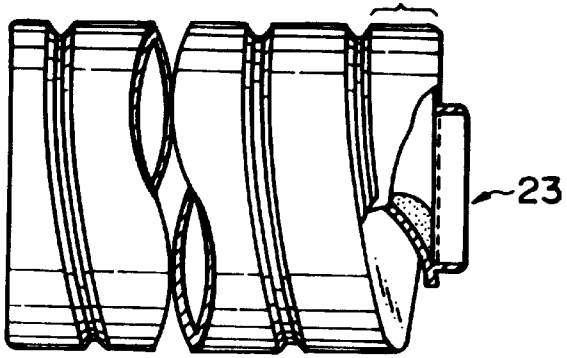
FIG. 23A is a front view of the toner bottle rotated 90 degrees from the position shown in FIG. 23B.
Figure 23B:
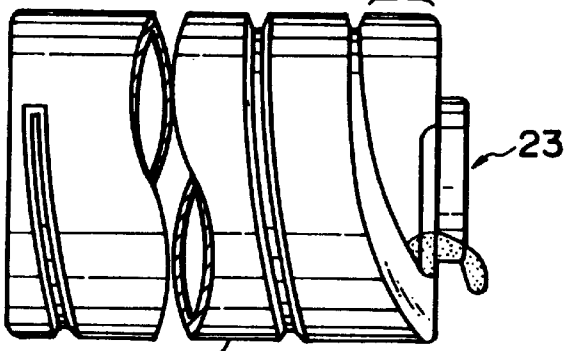
FIG. 23B is a front view of the toner bottle rotated 90 degrees from the position shown in FIG. 23A.
Figure 23C:
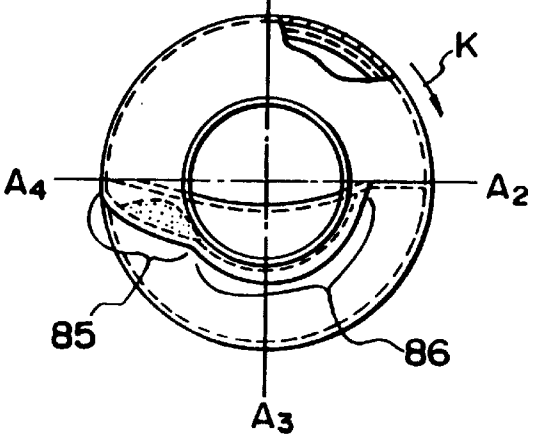
FIG. 23C is a side elevation of the toner bottle shown in FIG. 23A, as seen from the right.
Figure 23D:
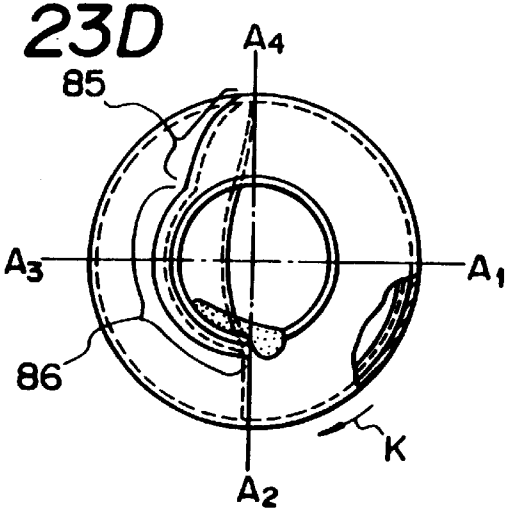
FIG. 23D is a side elevation of the toner bottle shown in FIG. 23B, as seen from the right.

In the condition shown in FIGS. 22A and 22C, the maximum diameter portion of the shoulder is located at the bottom in the vertical direction. Hence, the guide groove 27 guides the toner to the bottom of the maximum diameter portion of the head portion of the bottle 20. As shown in FIGS. 22B and 22D, when the bottle 20 is rotated 90 degrees in the direction K, the boundary between the maximum diameter portion of the shoulder and the raised portion 85 is positioned at the bottom in the vertical direction; the toner from the guide groove 27 partly rides on the raised portion 85. As shown in FIGS. 23A and 23C, while the bottle 20 is further rotated 90 degrees in the direction K toward the position of FIGS. 23A and 23C, the raised portion 85 raises the toner to the edge of the mouth portion 23 as if it were a spoon. When the bottle 20 is further rotated 90 degrees in the direction K to around the position of FIGS. 23B and 23D, the toner is partly transferred from the raised portion 85 to the inclined raised portion 86. As a result, the toner is guided by the raised portion 86 toward the outside of the bottle 20 in the direction L and then discharged via the mouth portion 23.

As best shown in FIG. 23C, the raised portion 85 itself is provided with a spoon-like concave configuration. When the bottle 20 has such a configuration adjacent the mouth portion 23, the toner powder is prevented from dropping from the mouth portion 23 in masses and raising a cloud in the hopper 16. That is, the toner powder is discharged little by little from the bottle 20 in a loose state. Moreover, hardly any of the toner is left in the bottle 20. In addition, while the bottle 20 is in rotation, only a so-to-speak spoonful of toner is scooped up to the mouth portion 23. As a result, a constant amount of toner is discharged from the mouth portion 23 at all times.

As shown in FIG. 24B, two pairs of raised portions 85 and 86 may be formed on the inner periphery of the shoulder of the bottle 20. In this case, the toner will be discharged in a quantity twice as great as the quantity available with a single pair of raised portions 85 and 86 for the same quantity of rotation of the bottle 20.

Figure 24C:
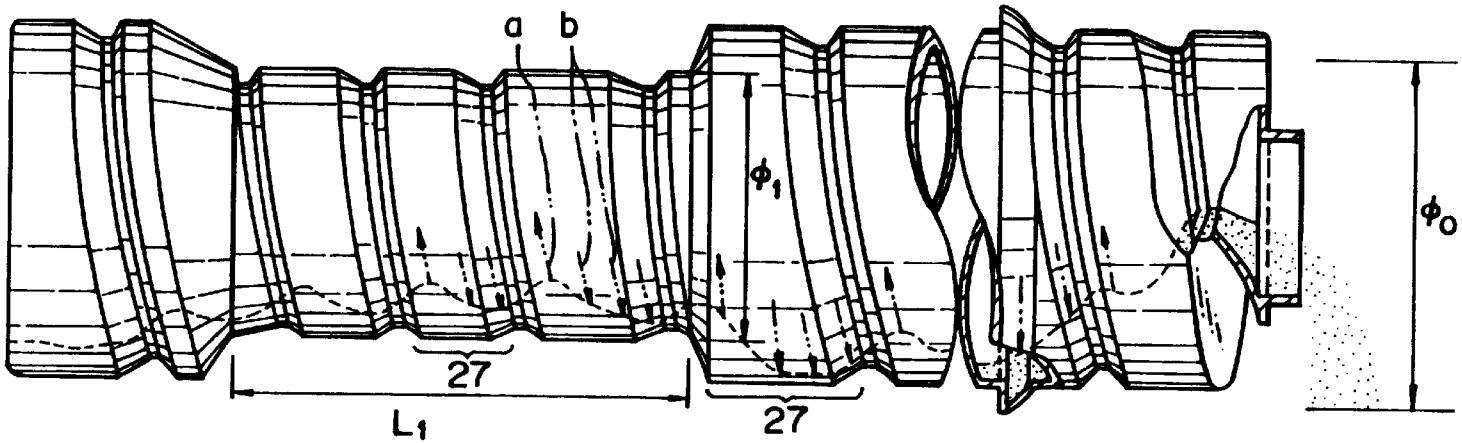

Further, as shown in FIG. 24C, the outer periphery of the bottle 20 may additionally include a grip portion $L_1$ having a diameter $\Phi_1$ smaller than the diameter $\Phi_0$ (greater than 100 mm) of the other portion. The outside diameter $\Phi_1$ of the grip portion $L_1$ should advantageously be 80 mm to 100 mm;

the length should advantageously be 80 mm to 100 mm. In FIG. 24C, the wall a forming the guide groove 27 has the same inner peripheral configuration as the configuration shown in FIG. 24A. In FIG. 24C, the arrow a is indicative of the toner being entrained by the inner periphery of the bottle 20 upward due to the rotation of the bottle 21, while the arrow b is indicative of the toner falling therealong.

Figure 25:
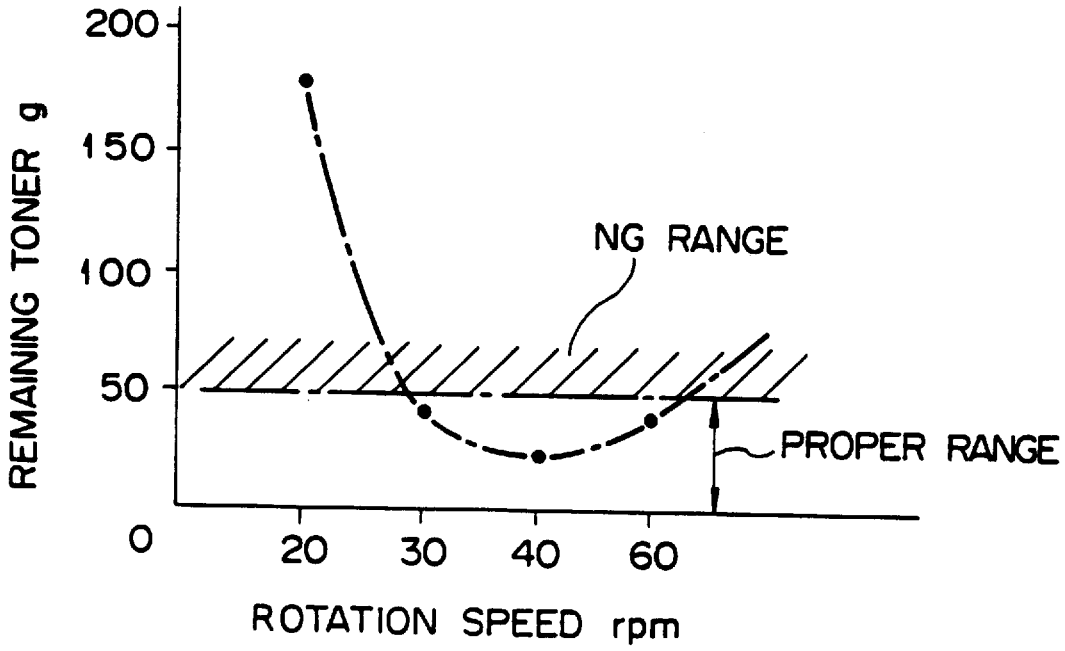
FIG. 25 is a graph indicative of a relationship between the rotation speed of the toner bottle and the quantity of toner left in the bottle without being discharged.

FIG. 25 is a graph indicative of a relation between the rotation speed (number of rotations per minute) of the bottle 20 during toner supply and the amount of toner left in the bottle 20 without being discharged. As shown, the amount of toner left in the bottle 20 depends on the rotation speed. For example, assuming that the allowable amount of toner to remain in the bottle 20 is up to 50 g, it is preferable to rotate the bottle 20 thirty rotations to forty rotations for a minute. Of course, the adequate rotation speed of the bottle 20 for reducing the amount of remaining toner is determined by, for example, the diameter of the mouth portion 23 and the configuration of the raised portions 85 and 86. In practice, therefore, the adequate rotation speed is determined by experiments beforehand, and the bottle 20 is rotated at such a speed.

Figure 26A:
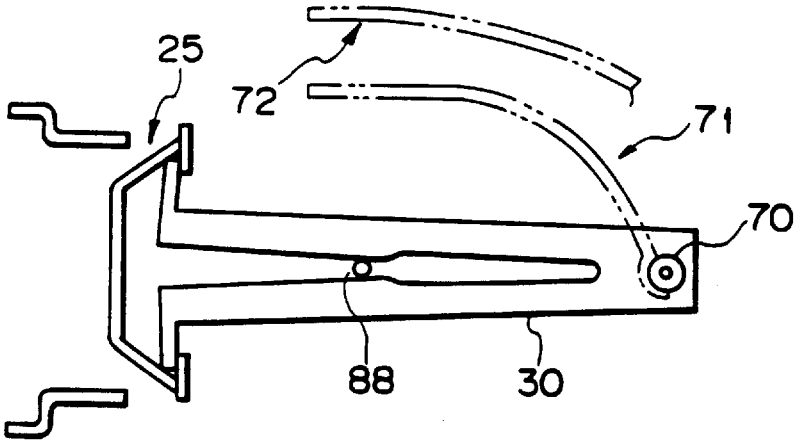
FIGS. 26A and 26B each demonstrates a particular operation available with a modified collet chuck.
Figure 26B:
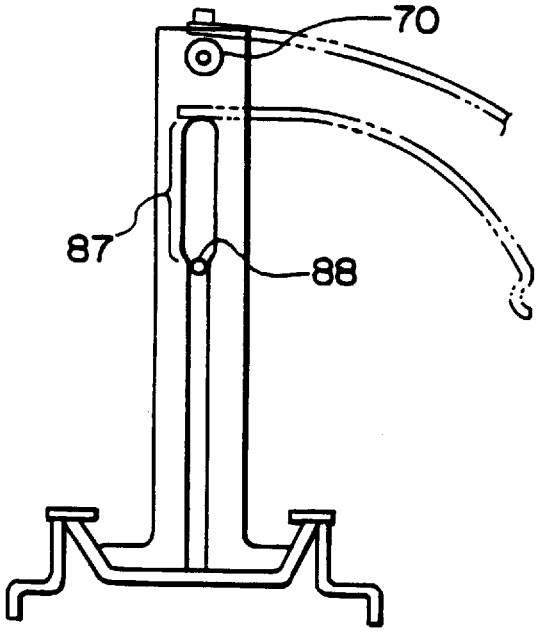

In the illustrative embodiment, the toner supply unit 17 is constructed such that the collet chuck 30 retains the lug 26 of the lid 25 when the tip thereof is squeezed. Alternatively, as shown in FIG. 26A, the chuck 30 may cause the tip thereof to abut against the inner periphery of the annular wall of the lid 25 and retain the lid 25 when opened. FIG. 26B shows a condition wherein the tip of such a chuck 30 has been squeezed to release the lid 25. In the chuck 30 shown in FIGS. 26A and 26B, the the slit has a rear portion 87 which is broader than the front or tip portion. A pin 88 is studded in a predetermined position of, for example, the stop cover 48. When the chuck 30 is moved relative to the pin 88 such that the pin 88 enters the narrower tip portion of the slit, the slit, i.e., the tip portion thereof is opened. When the chuck 30 is moved such that the pin 88 enters the rear portion 87 of the slit, the tip of the chuck 30 does not contact the lid 25. FIGS. 26A and 26B show respectively a position matching the position B of the bottle holder 21 and a position matching the position A of the same.

Referring to FIGS. 27–30, a modified form of the toner supply unit 17 will be described. In the figures, the same or similar constituents as or to the constituents of the previous configuration are designated by the same reference numerals.

In the modification, the toner supply unit 17 is also rotatable substantially 90 degrees between the positions A and B in a substantially horizontal plane about the center of rotation Z, FIG. 1B. To rotatably support the bottle holder 21 about the center of rotation Z, the mechanism described previously may also be used. Again, the toner supply unit 17 has the locking mechanism for positioning the bottle 20 on the bottle holder 21, motor 37 for rotating the bottle 20, gear link 38 for transmitting the rotation of the motor 37 to the bottle 20, collet chuck 30 for retaining the lid 25 of the bottle 20, core 39 slidably mounted on the chuck 30, and cam device for moving the chuck 30 back and forth.

Figure 27:
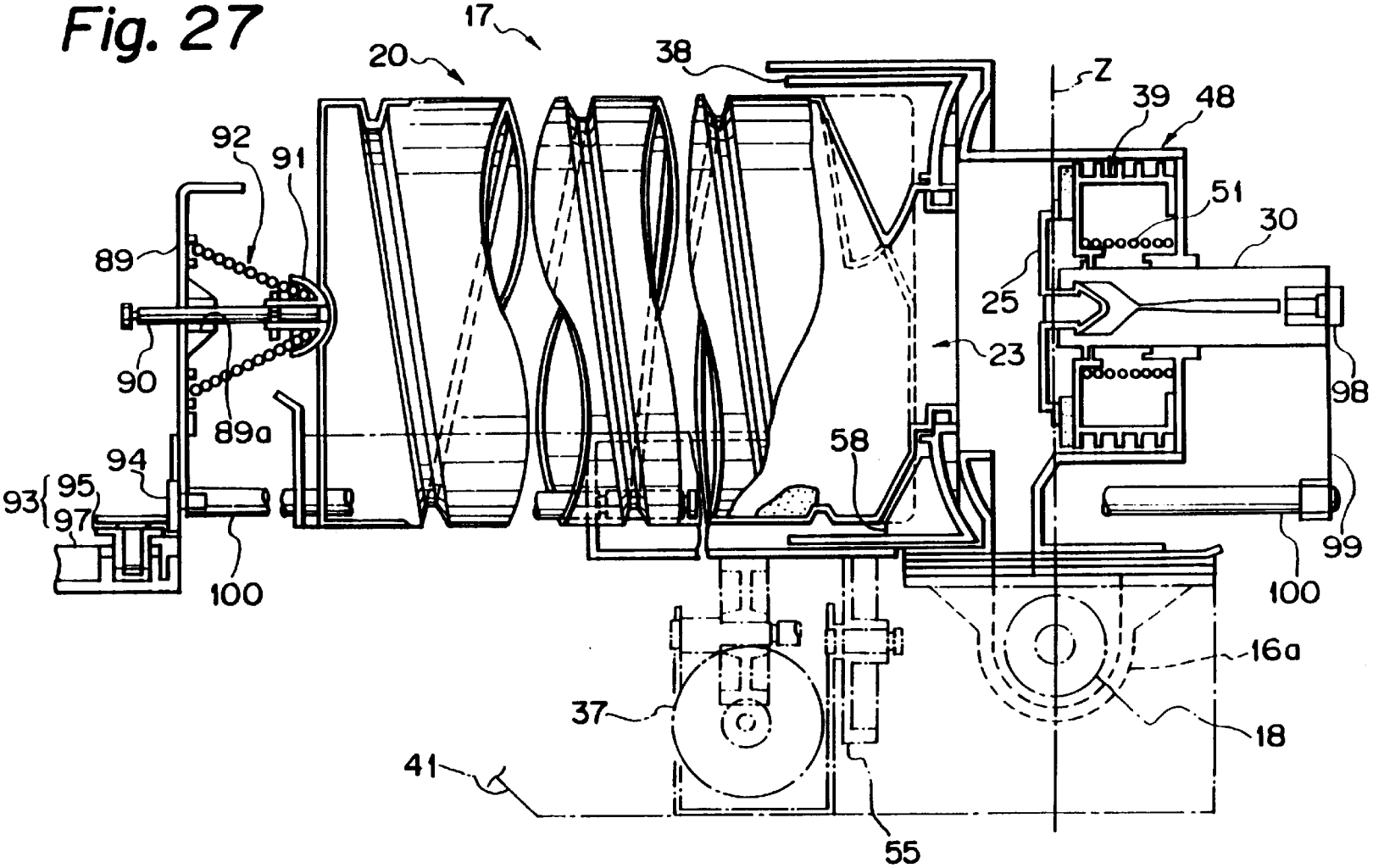
FIG. 27 is a front view of another specific arrangement of the toner supply unit held in a toner replenishing position.
Figure 28:
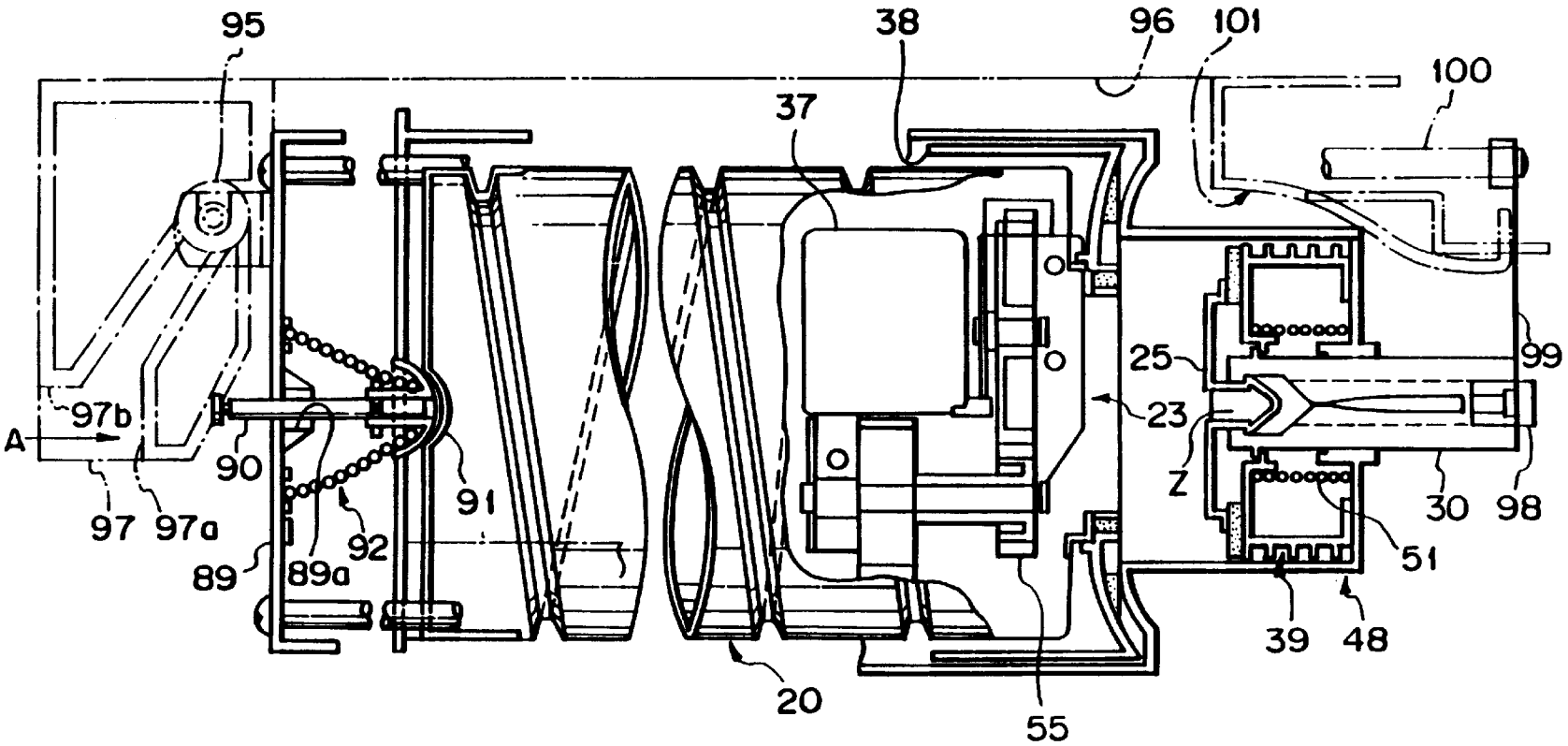
FIG. 28 is a plan view of the toner supply unit shown in FIG. 27.

The modification differs from the previous embodiment, as follows. To begin with, in the previous embodiment, the cam device for moving the chuck 30 back and forth is located adjacent the center of rotation Z of the bottle holder 21. By contrast, in the modification, the cam device is located at a position comparatively remote from the center of rotation Z in the longitudinal direction of the bottle holder 21. Specifically, as shown in FIGS. 27 and 28, the cam device, generally 93, has a cam member 97 affixed to the portion of a copier front wall 96 that will face the end of the bottle holder 21 remote from the center of rotation Z when the holder 21 is held in the position B (referred to as movable end hereinafter). In addition, the cam device 93 has a roller 95 mounted on the movable end of the bottle holder 21 and provided with a flange. Specifically, the roller 95 is rotatably mounted on a plate 94 which is in turn affixed to a bracket 89. The bracket 89 is affixed to the bottle holder 21 or the movable bracket 41 in the vicinity of the rear end of the bottle 20 (opposite to the end where the mouth portion 23 is positioned) in such a manner as to be movable toward and away from the rear end of the bottle 20. The bracket 89 and an arm member 99 fastened to the rear end of the chuck 30 by a screw 98 are connected together by a shaft 100 extending in the lengthwise direction of the bottle holder 21.

Figure 29A:
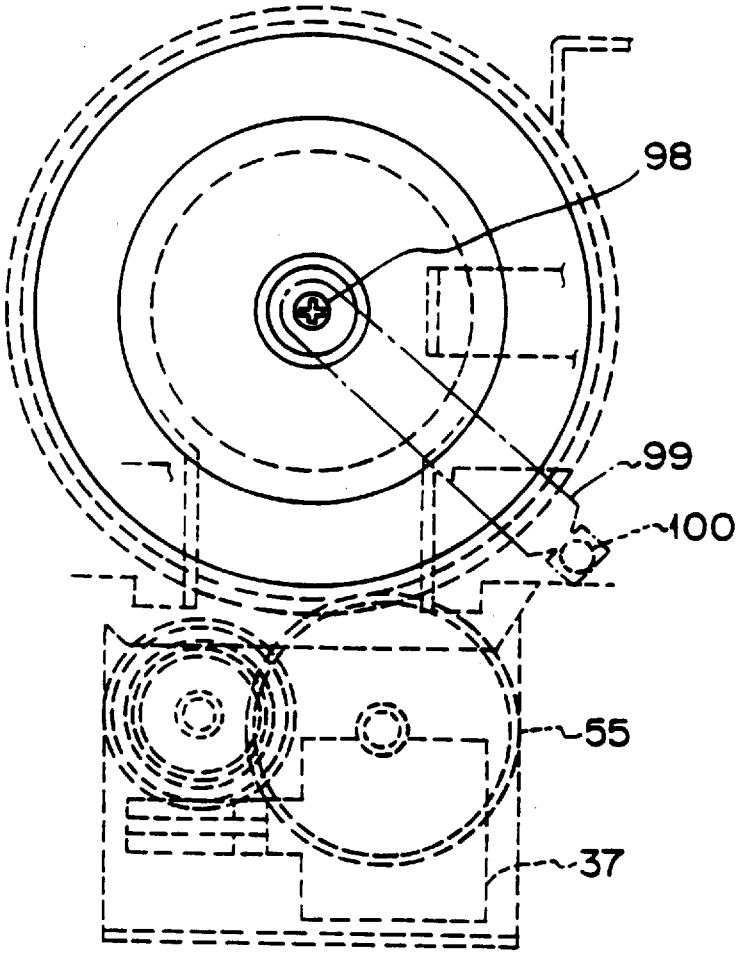
FIG. 29A is a side elevation of the unit shown in FIG. 27, as seen from the right.
Figure 29B:
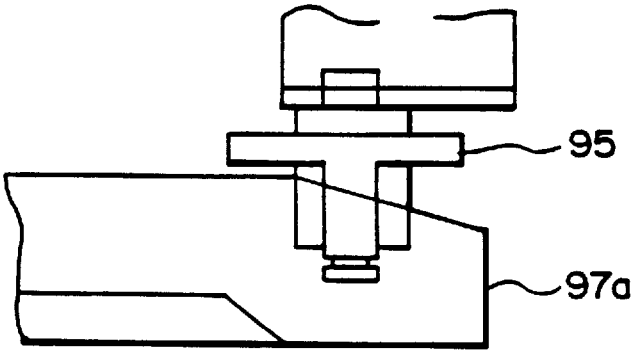
FIG. 29B is a fragmentary enlarged view as seen in a direction A shown in FIG. 28.

The cam member 97 is made up of a pair of fence members 97*a* and 97*b* facing each other. The fence members 97*a* and 97*b* guide the roller 95 from the side and support the flange of the roller 95 from below the roller 95. The fence members 97*a* and 97*b* are configured such that the distance from the center of rotation Z decreases with the decrease in the distance to the front wall 96 decreases. As shown in FIG. 29B, the front end portion of the fence member 97*a* is inclined downward toward the front end such that the roller 95 can start contacting it smoothly just before the bottle holder 21 is fully moved from the position A to the position B.

The bracket 89 has a boss 89*a* on the vertical wall thereof. A rod 90 is slidably received in a hole surrounded by the boss 89*a* of the bracket 89. An abutment 91 is affixed to the rod 90 and capable of abutting against the rear end of the bottle 20. A spring is loaded between the vertical wall of the bracket 89 and the abutment 91 and constantly biases them away from each other.

In operation, when the bottle holder 21 is held in the position B, the roller with the flange 95 is held in a position closest to the base end of the bottle holder 21 by the cam member 97, as shown in FIGS. 27 and 28. The collet chuck 30 connected to the roller 95 by the shaft 100 is also located at a position closest to the base end of the bottle holder 21. In this condition, the chuck 30 retains the lid 25 at a position remote from the mouth portion 23 of the bottle 20, thereby allowing the toner from being discharged from the mouth portion 23. The bottle 20 has the rear end thereof urged by the abutment 91 and spring 92 toward the base end of the bottle holder 21. The end of the bottle 20 having the mouth portion 23 is abutted against the end of the stop cover 48. Therefore, the bottle 20 is positioned in the longitudinal direction of the bottle holder 21. In this sense, the abutment 91, as well as the members associated therewith, constitute a mechanism for positioning the bottle 20 on the bottle holder 21.

When the bottle holder 21 is moved from the position B to the position A, the roller 95 is guided by the cam member 97 toward the movable end of the bottle holder 21. At the same time, the chuck 30 is moved toward the mouth portion 23 of the bottle 20. While the roller 95 is so guided by the cam member 97, the lid 25 held by the chuck 30 is fully inserted into the mouth portion 23 when the distance between the bracket 89 and the stop cover 48 is shorter than the sum of the length of the bottle 20 and the unstressed length of the spring 92 and when the abutment 91 is positioning the bottle 20. If desired, to generate a sufficient force for inserting the lid 25, a cam member, not shown, may be provided against which the rear end of the rod 90 abuts when the bottle holder 21 is moved from the position B to the position A. Then, the rod 90, compared to the bracket 89, will be continuously urged toward the chuck 30 and cause the rear end of the bottle 21 to abut against the abutment 91 of the rod 90.

Figure 30:
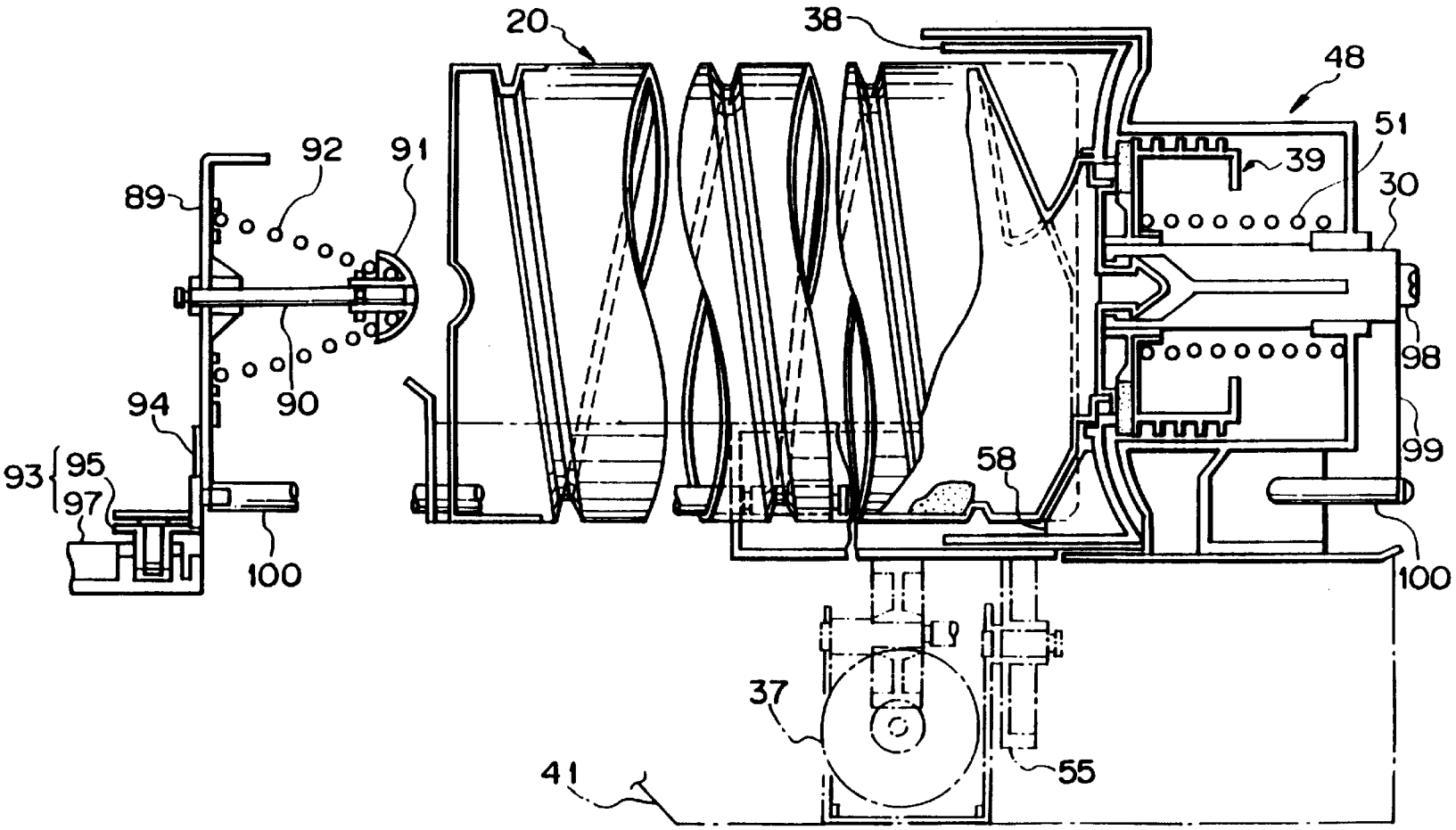
FIG. 30 is a front view of the toner supply unit held in a position for mounting a toner bottle.

As the bottle holder 21 is further moved toward the position A, the roller 95 is released from the cam member 97. FIG. 30 shows a condition wherein the bottle holder 21 has arrived at the position A. In this condition, the mouth portion 23 of the bottle 20 has been fully sealed by the lid 25, the chucking portion of the chuck 30 has been opened wide enough to release the lug 26 of the lid 25, and the abutment 91 has been moved away from the rear end of the bottle 20.

Assume that the chuck 30 has been accidentally retracted toward the base end of the bottle holder 21 after the roller 95 had been released from the cam member 97. Then, the larger diameter portion 63 of the chuck 30 (see FIG. 31A) will be engaged with and squeezed by the core 39 which is stopped by the stop cover 48, chucking the lug 26 of the lid 25. This obstructs the removal of the bottle 20 and the insertion of a new bottle 20. In the light of this, as shown in FIG. 28, a cam member 101 is additionally located adjacent the center of rotation Z and provided with a particular cam surface. Specifically, while the roller 95 and cam member 97 are released from each other, the cam surface of the cam member 101 restricts the rear end of the chuck 30 such that the chuck 30 does not retract toward the base end of the bottle holder 21. The cam member 101 may also implement the relative position of the chuck 30 and core 39 for opening the chucking portion 33 thereof, if desired.

When the bottle holder 21 is moved from the position A to the position B, the roller 95 is brought into contact with the cam member 97. Subsequently, the bracket 89 and chuck 30 are each moved toward the base end of the bottle holder 21. As a result, the bottle 20 is positioned on the bottle holder 21 while the lid 25 is removed from the bottle 20. The resulting condition is shown in FIGS. 27 and 28.

Another difference between the previously described toner supply unit 17 and the toner supply unit 17 described above is as follows. The previous toner supply unit 17 maintains the chucking portion 33 of the chuck 30 sufficiently open by setting up a condition which prevents an external force tending to squeeze the portion 33 from acting. By contrast, the toner supply unit 17 described above applies an external force tending to open the chucking portion 33 to the portion 33 positively.

Figure 31A:
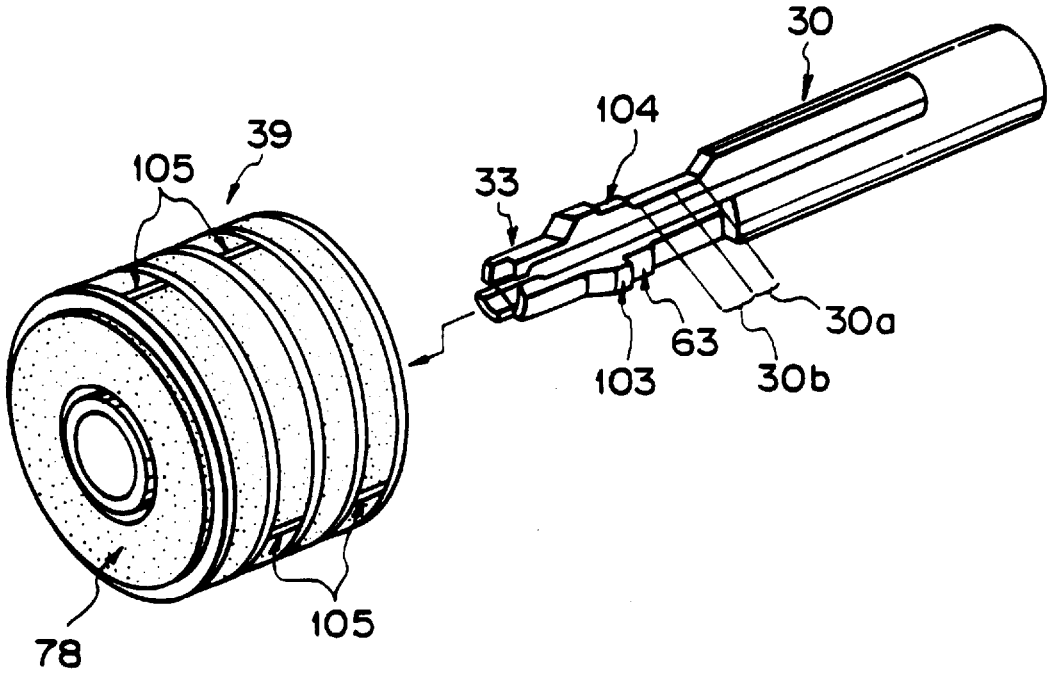
FIG. 31A is an exploded perspective view of a collet chuck and a core included in the unit of FIG. 27.
Figure 31B:
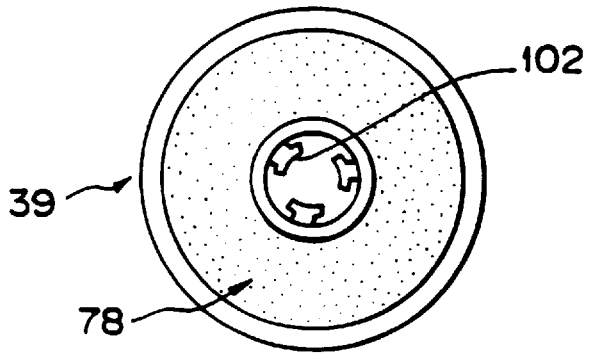
FIG. 31B is a front view of the core.

Specifically, as shown in FIG. 31A, the chuck 30 has a slit portion 30*a* positioned at the rear of a slit portion 30*b* contiguous with the portion 30*a* and having a greater width than the portion 30*a*. The chuck 30 is slidable in the bore formed in the core 39. As shown in FIG. 31B, the inner periphery of the core 39 is formed with projections 102 which are received in the individual (three in this case) slits of the chuck 30. Further, the chuck 30 has a portion 103 even larger in diameter than the larger diameter portion 63, and a substantially vertical abutment or shoulder 104 between the portions 103 and 63.

The core 39 shown in FIG. 31A is substantially identical with the core 39 of FIG. 14A except for the projections 102. In FIG. 31A, the reference numeral 105 designates the opposite ends of each seal member which are abutted against each other.

Figure 32A:
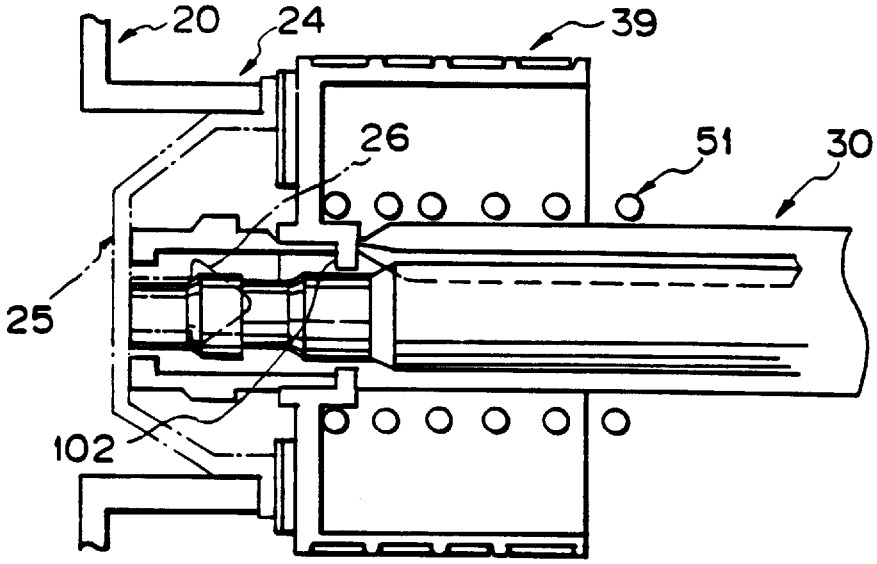
FIGS. 32A and 32B each demonstrates a specific operation of the collet chuck shown in FIG. 31A.
Figure 32B:
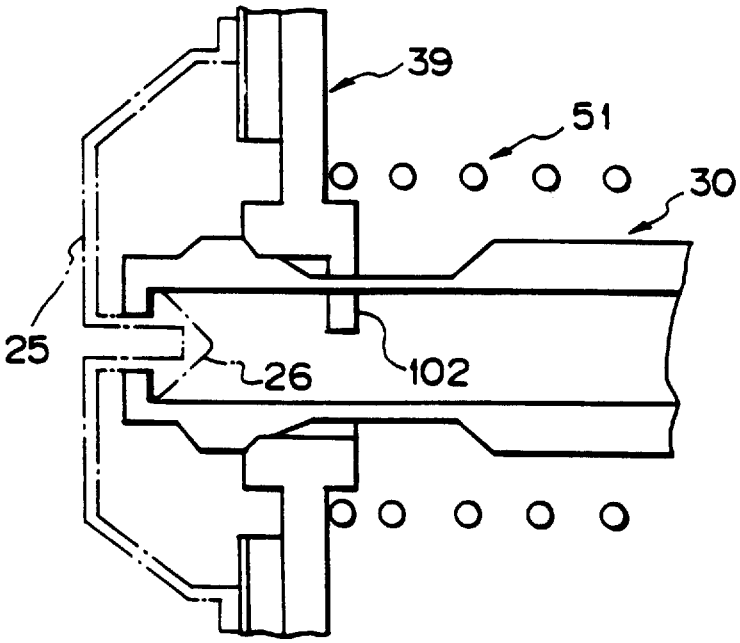

FIGS. 32A and 32B are views representative of a relation between the above-stated chuck 32 and the core 39 and the position of the chucking portion 33. Specifically, FIG. 32A shows a condition wherein the core 39 is abutted against and stopped by the stop cover 48 (not shown) when, for example, the bottle holder 21 is held in the position A. In this condition, the projections 102 of the core 39 are positioned in the individual narrow slit portions 30*a*, opening the chucking portion 33 positively by wedging them. On the other hand, FIG. 32B shows a condition wherein the collet chuck 33 is retracted a certain distance due to the contact of the roller 95 and cam member 97 when, for example, the bottle holder 21 is brought from the position A to the position B. In this condition, the boss of the core 39 biased by the spring 51 is stopped by the shoulders 104 of the chuck 30, squeezing the chucking portion 33.

Figure 33:
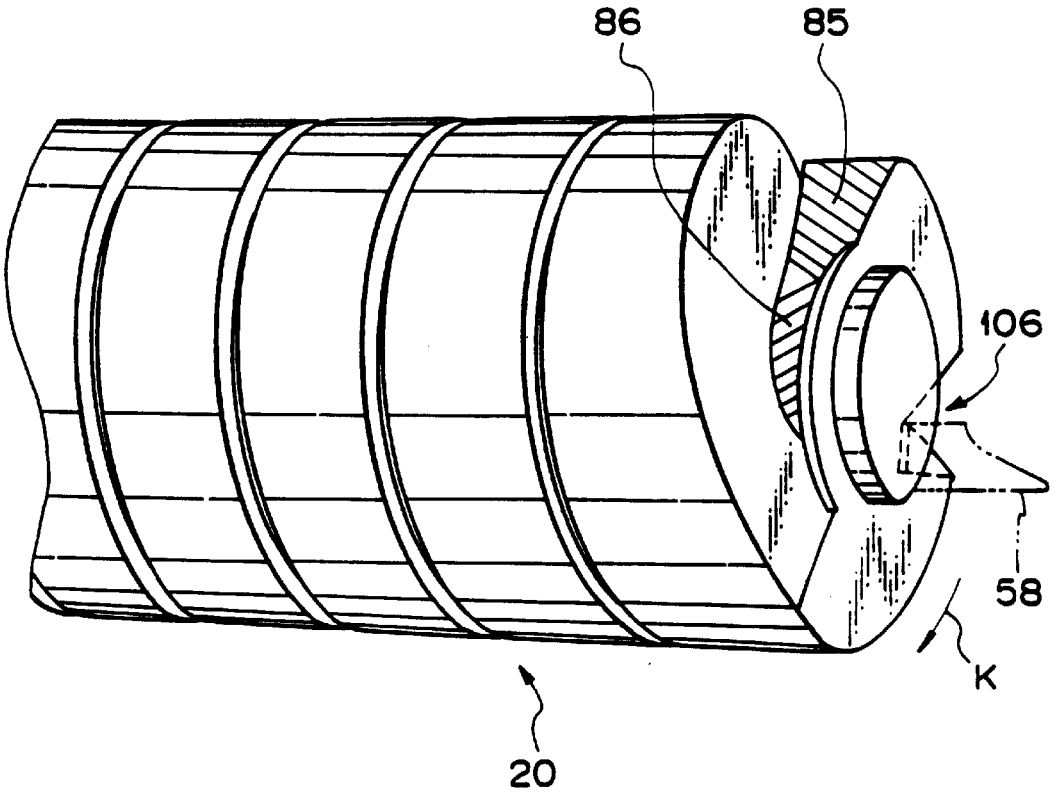
FIG. 33 is a fragmentary enlarged view of a toner bottle for use with the toner supply unit of FIG. 27.

Furthermore, the previous toner supply unit 17 transmits the rotation of the gear link 38 to the bottle 20 by forming the bottle ribs 57 on the end of the bottle 20 having the mouth portion 23 and forming the link ribs 58 on the end of the gear link 38. On the other hand, as shown in FIG. 33, the modified toner supply unit 17 provides the bottle 20 with a recess 106 in place of the bottle rib 57 and causes the link rib 58 to mate with the recess 106. However, a transmission mechanism similar to the mechanism of the previous embodiment may also be used, as shown in FIG. 34A–34D. FIG. 34D shows the inner peripheral configuration of the gear link 38, as viewed in the direction indicated by an arrow A in FIG. 34C.

Figure 34B:
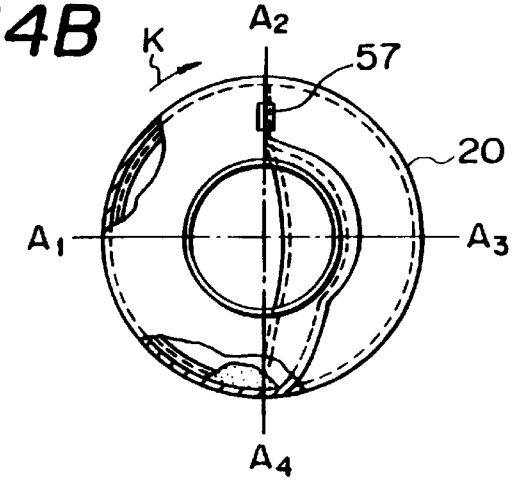
FIG. 34B is a side elevation of the toner bottle, as seen from the right.
Figure 34D:
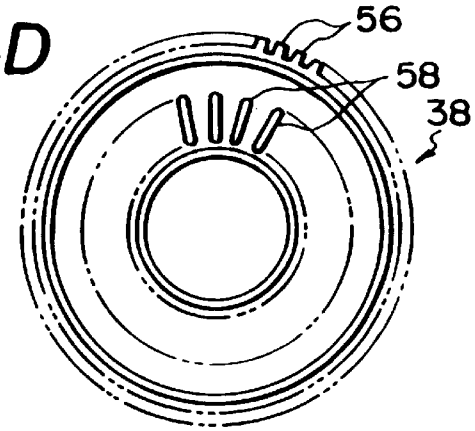
FIG. 34D is a view as seen in a direction A shown in FIG. 34C.
Figure 34A:
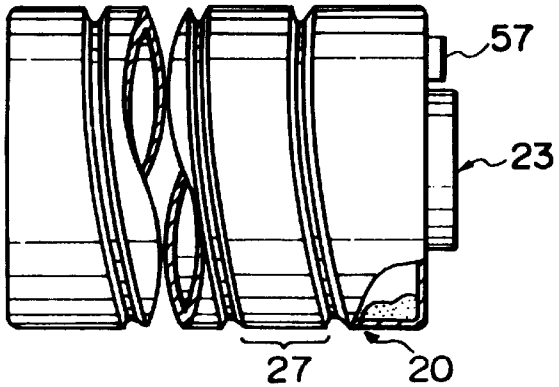
FIG. 34A is a front view showing a modified toner bottle for used with the toner supply unit of FIG. 27.
Figure 34C:
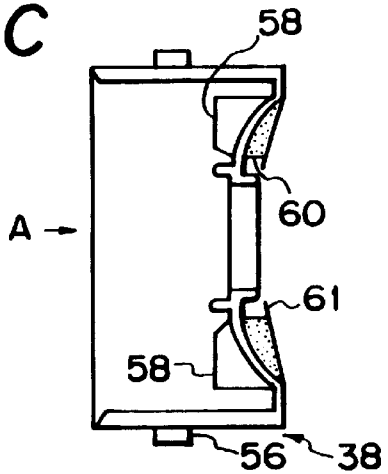
FIG. 34C is a section of a gear link associated with the toner bottle.
Figure 35A:
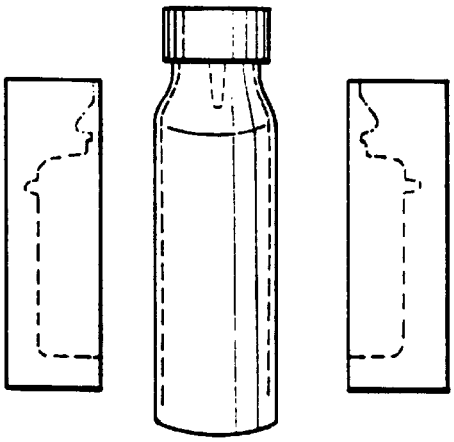
FIGS. 35A–35E show a sequence of steps for producing a toner bottle in accordance with the present invention.
Figure 35B:
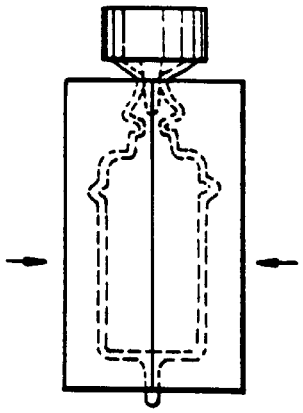
Figure 35C:
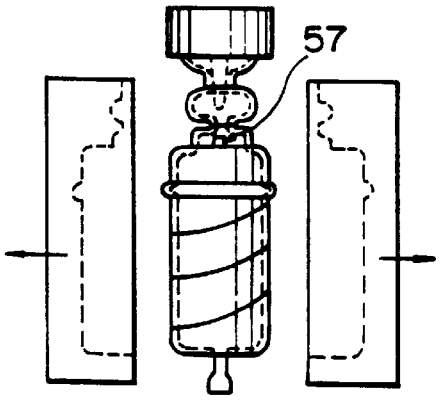
Figure 35D:
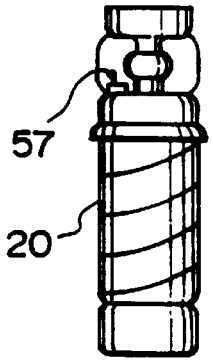
Figure 35E:
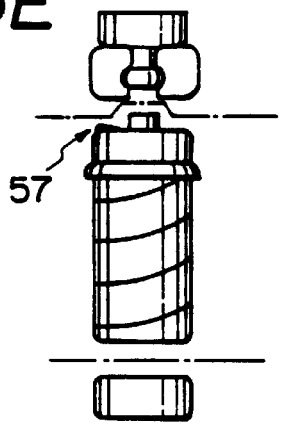

Assume that the bottle rib 57 is formed on the outer periphery of the bottle 20, as shown in FIGS. 34A and 34B, and that the bottle 20 is molded by use of resin. Then, as shown in FIGS. 35A–35E, it is preferable to form the bottle rib 57 in a parting line portion between mold parts. This allows the bottle 20 to have a relatively thick wall at the portion where the rib 57 is positioned, compared to a case wherein the rib 57 is located in any other position. Any desired number of ribs 57 may be formed if they are provided at the parting portions of cooperative mold parts. Specifically, two parting lines are available with the two bisected mold parts shown in FIGS. 35A–35E. Four parting lines will be available when four mold parts are used.

Figure 36A:
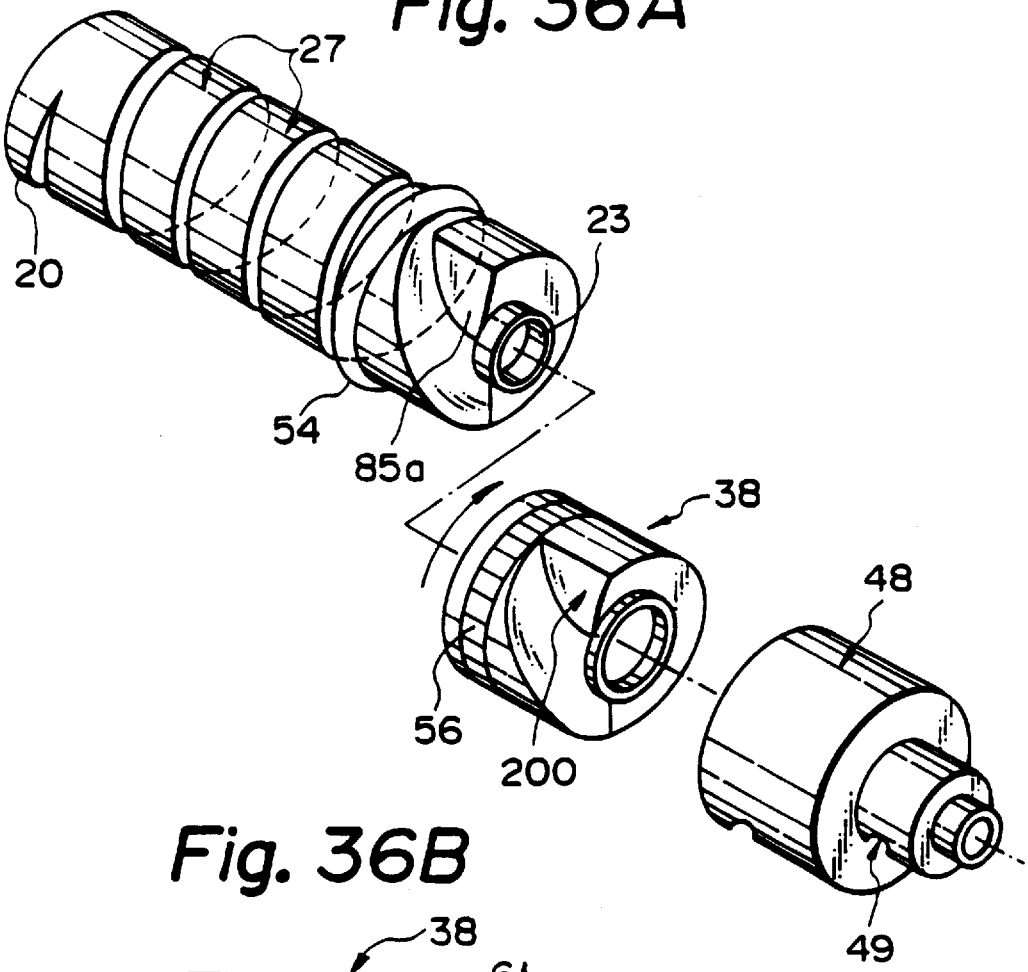
FIG. 36A is a perspective view of a toner bottle and an annular link Included in a modification of the present invention.
Figure 36B:
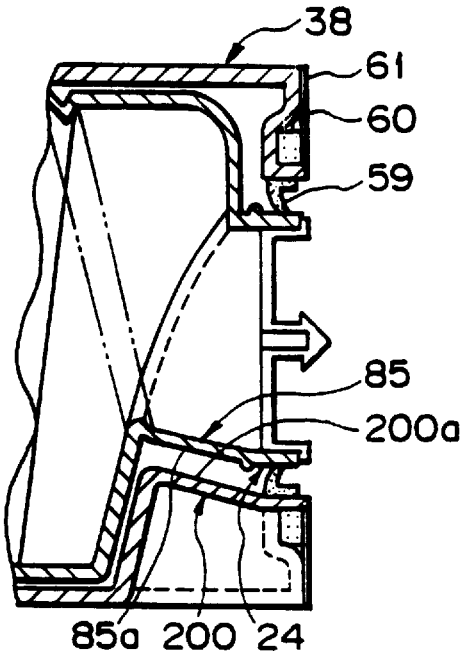
FIG. 36B shows the toner bottle inserted into the annular link.

The recess 106, FIG. 33, formed in the bottle 20 is a specific implementation for transmitting the rotation of the gear link 38 to the bottle 20. Alternatively, at the shoulder of the bottle 20, the part of the outer periphery corresponding to the inner peripheral raised portion 85 may be brought into engagement with the link rib 58 or similar engaging portion of the gear link 38, as shown in FIGS. 36A and 36B by way of example. As shown in FIG. 36A, the gear link 38 has an engaging portion 200 engageable with the portion 85*a* of the outer surface of the bottle 20 corresponding to the inner raised portion 85. When the head portion of the bottle 20 is inserted into the gear link 38, the engaging portion 200 engages with the portion 85*a* of the bottle 20. FIG. 36B shows the portion 85*a* of the bottle 20 and the portion 200 of the gear link 38 abutting against each other. In FIG. 36B, the reference numeral 200*a* designates the surface of the portion 200 directly contacting the portion 85*a*. When the portions 85*a* and 200 substantially perpendicular to the direction of rotation are brought into engagement, the bottle 20 is caused to rotated about the axis thereof together with the gear link 38. This kind of drive transmission makes it needless to form the bottle rib 57 or similar projection on the bottle 20 and, therefore, reduces the production cost of the bottle 20. In addition, drive transmission is insured since the engaging portion 200 of the gear link 38 abuts against the portion 85*a* of the bottle 20.

Figure 37:
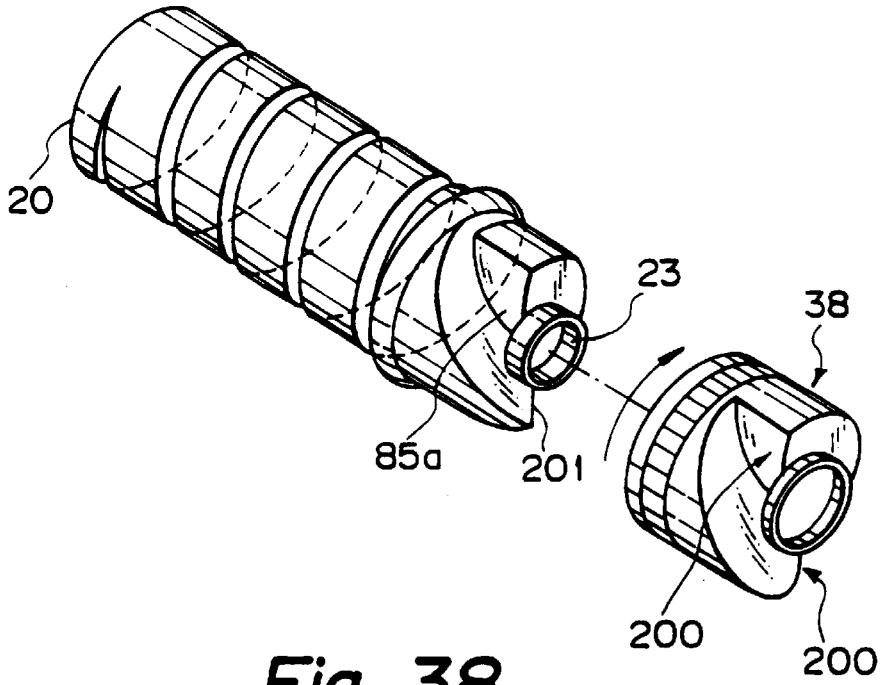
FIGS. 37 and 38 are perspective views each showing a toner bottle and an annular link included in another modification of the present invention.
Figure 38:
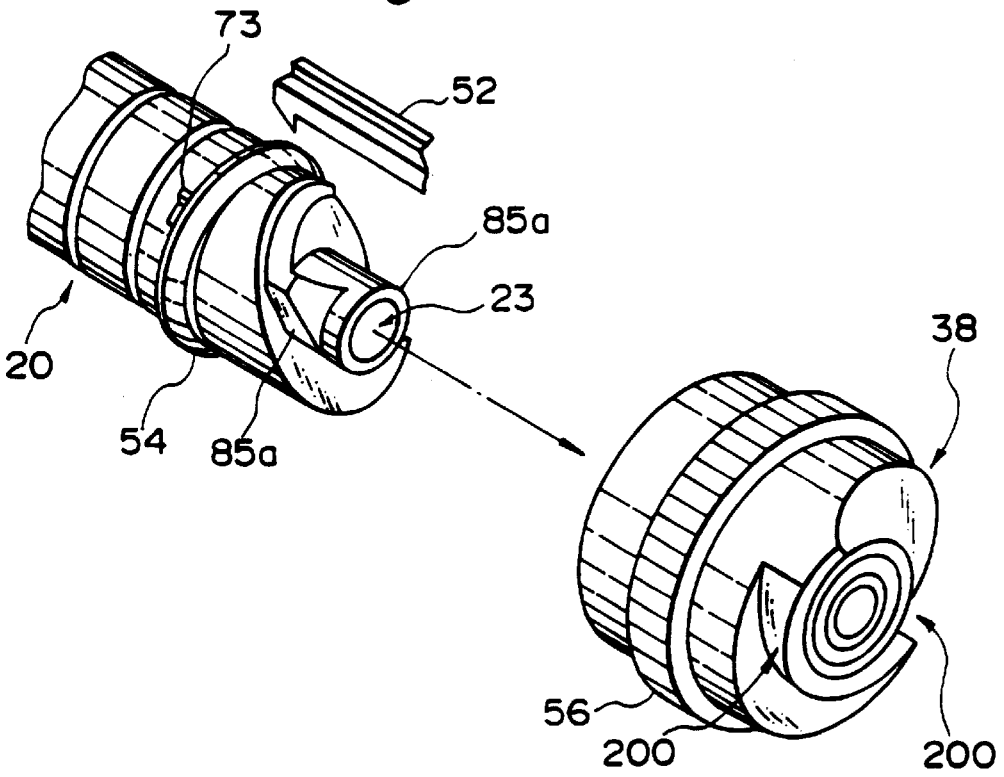
Figure 39A:
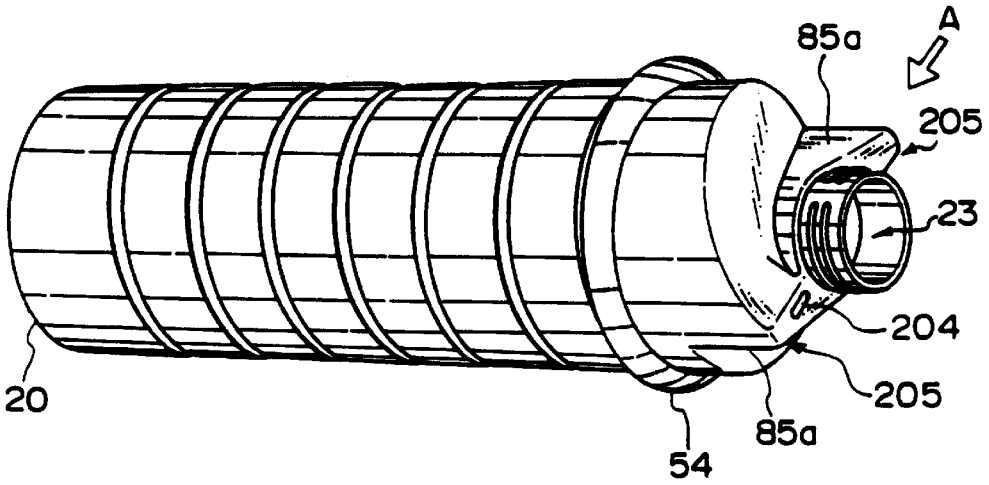
FIG. 39A is a perspective view showing another specific configuration of the toner bottle.
Figure 39B:
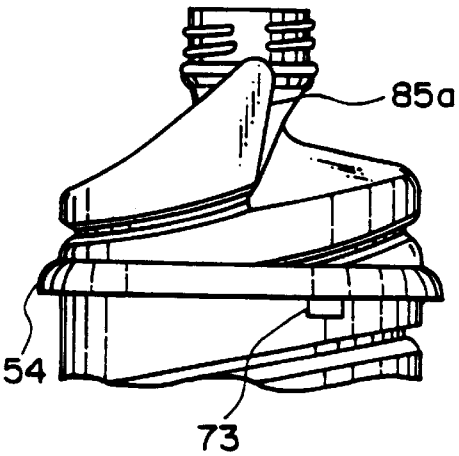
FIG. 39B is a fragmentary view of the toner bottle.
Figure 39C:
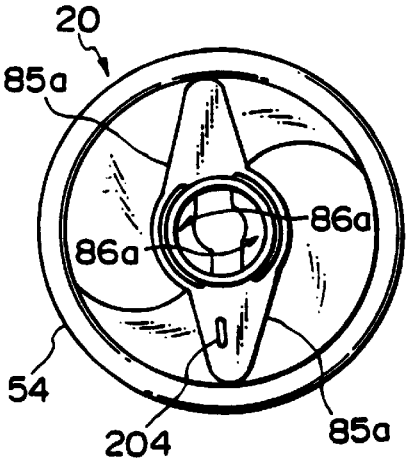
FIG. 39C is a plan view of the toner bottle.

As shown in FIG. 37, the bottle 20 may be provided with two contact surfaces on the end thereof. As shown, a contact surface 201 is formed at a position 180 degrees spaced apart from the above-stated portion 85*a* in the direction of rotation of the bottle 20. The gear link 38 is formed with two engaging portions 200 engaging the surfaces 85*a* and 201 of the bottle 20, respectively. In this case, the inner periphery of the bottle 20 corresponding to the additional contact surface 201 may also be configured as a raised portion for raising the toner.

FIGS. 38 and 39A–39C show another specific configuration of the bottle 20. As shown, the bottle 20 has two raised portions 85 (represented by the corresponding outer peripheral portions 85*a*) which are spaced apart 180 degrees in the direction of rotation of the bottle 20 and symmetrical to each other with respect to the axis of the bottle. In the figures, the same portions as the portions of any one of the previous specific configurations are designated by the same reference numerals. In this configuration, while the bottle 20 performs one rotation, the toner is guided twice to the mouth portion 23 along the raised portions 85. Hence, when only a small quantity of toner is left in the bottle 20, it can be discharged from the mouth portion 23 more positively. Moreover, since the bottle 20 and the gear link 38 are engaged with each other at two spaced positions, the sure drive transmission from the link 38 to the bottle 20 is further promoted.

Generally, the characteristic of a toner, e.g., chargeability and color depend on the developing unit. Therefore, it is necessary to prevent a bottle 20 containing a toner different in characteristic from an expected toner from being mounted to the toner supply unit 17. For this purpose, the bottle 20 shown in FIG. 38 and 39A–39C is provided with a lug 204 in a portion thereof extending from the circumferential edge of the color 24 to a shoulder 205. The lug 204 is sized and positioned in matching relation to the characteristic of the toner to be contained in the bottle 20. The end wall of the gear link 38 is formed with a recess in the inner surface thereof which can receive the lug 204 of a bottle 20, containing an expected toner, when the bottle 20 is inserted into the link 38. When a bottle containing an unexpected toner is put on the toner supply unit 17, it cannot be fully inserted into the gear link 38 since the lug 204 does not match the recess of the link 38 in size or position. If desired, the bottle 20 and the gear link 38 may be provided with the recess and the lug, respectively.

Figure 40A:
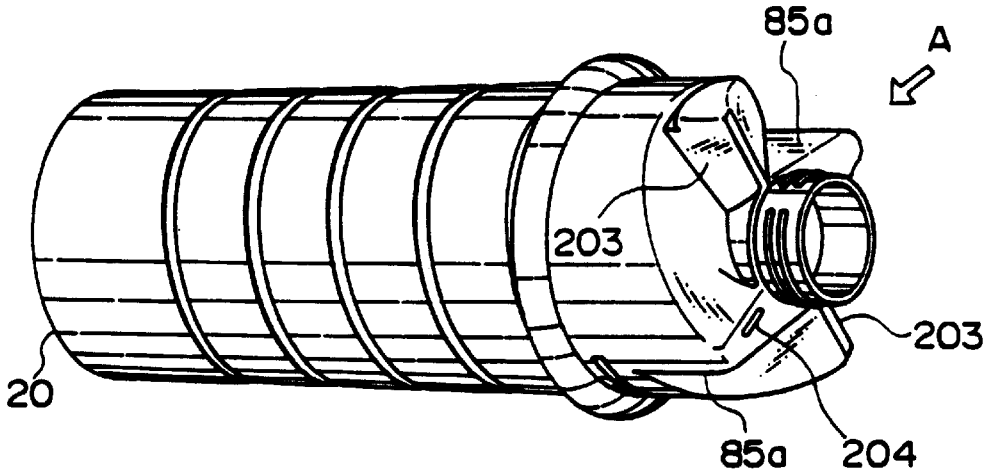
FIG. 40A is a perspective view showing another specific configuration of the toner bottle.
Figure 40B:
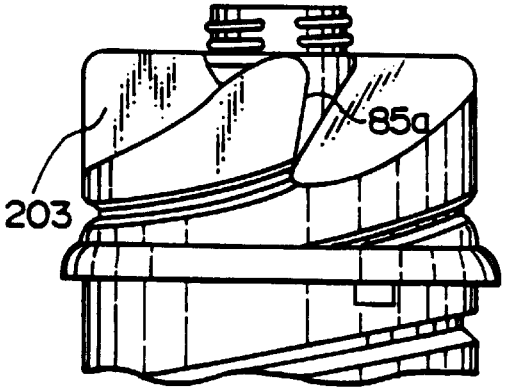
FIG. 40B is a fragmentary view of the toner bottle.
Figure 40C:
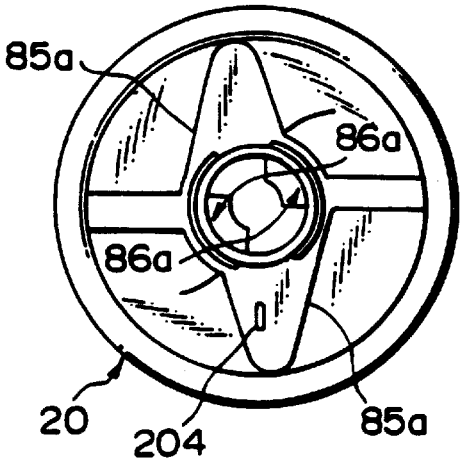
FIG. 40C is a plan view of the toner bottle.

The bottle 20 may be provided with three or more engaging portions engageable with the gear link 38 or three or more raised portions 85 in order to more surely transmit the rotation of the link 38 to the bottle 20 or to further promote the discharge of a small quantity of toner remaining in the bottle 20. Again, such engaging portions or raised portions should preferably be located at equally spaced locations in the direction of rotation of the bottle 20. Specifically, FIGS. 40A–40C show the bottle 20 having the raised portions (represented by the outer surfaces 85*a* corresponding thereto) and engaging portions 203 which alternate with each other at angular intervals of 90 degrees. In these figures, the same portions as the portions of any one of the specific bottle configurations shown and described are designated by the same reference numerals.

Figure 41:
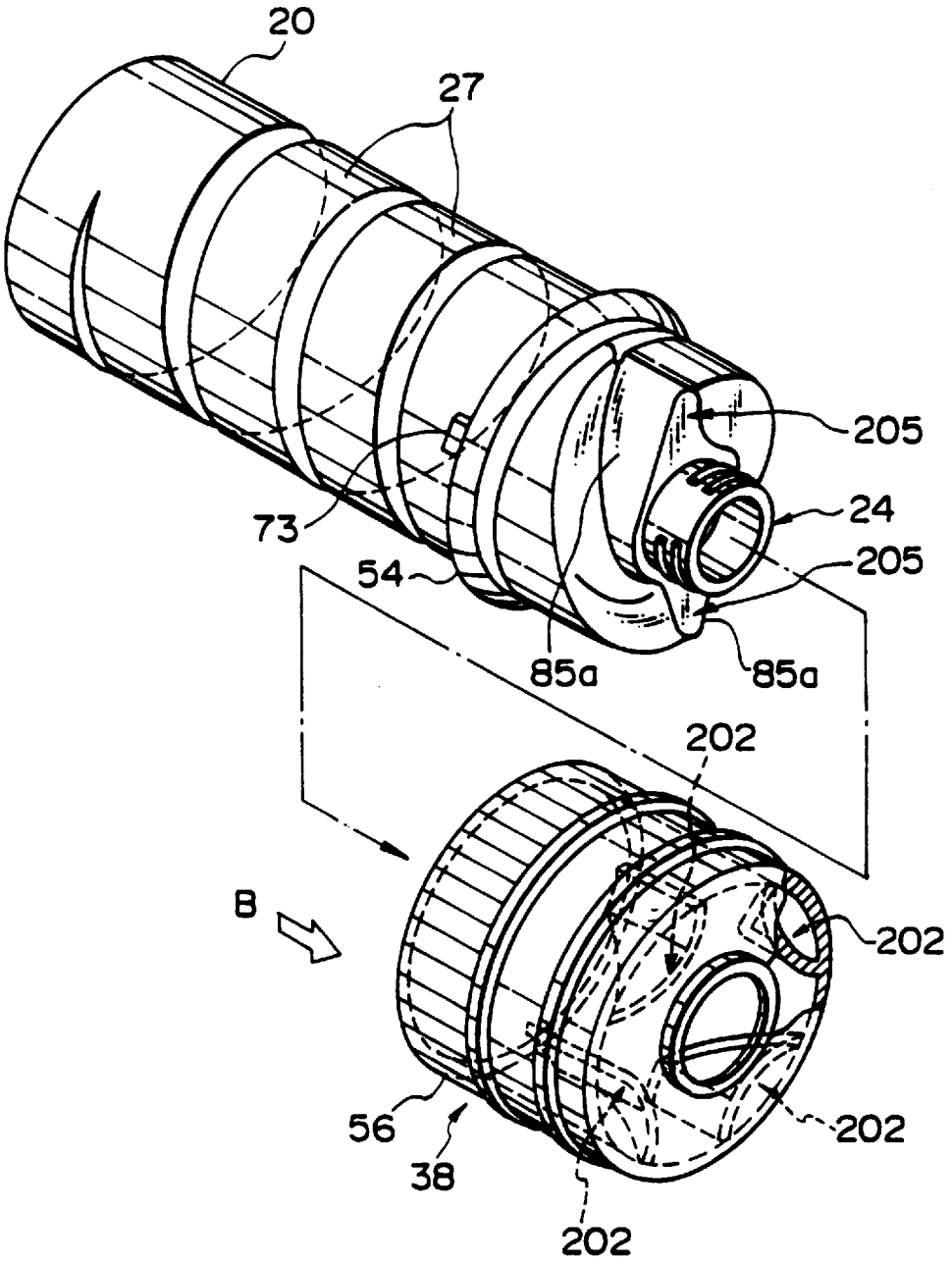
FIG. 41 is a perspective view of a toner bottle and an annular link included in another modification of the present invention.
Figure 42A:
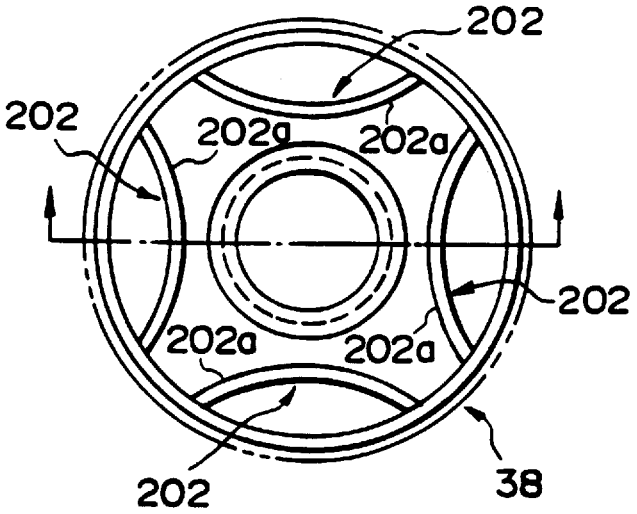
FIGS. 42A shows the internal arrangement of the annular link shown in FIG. 41.
Figure 42B:
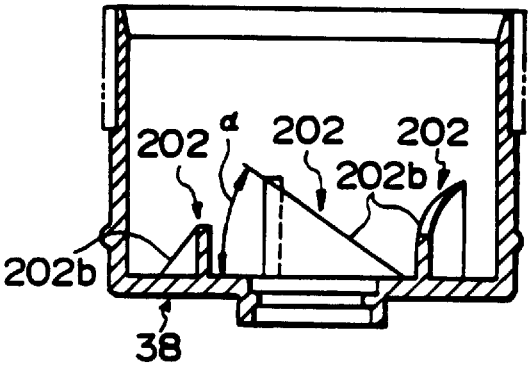
FIG. 42B is a section of the annular link.
Figure 42C:
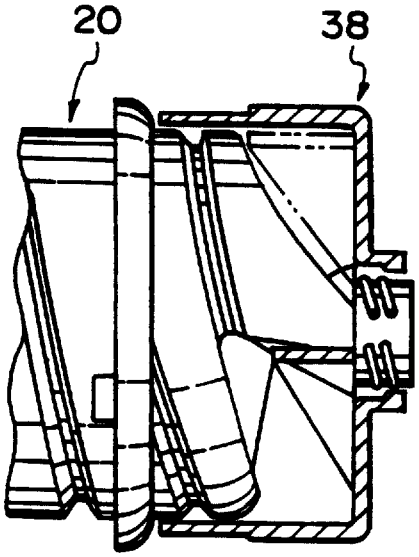
FIG. 42C shows the toner bottle inserted into the annular link.

The gear link 38 may be provided with a greater number of engaging portions than the bottle 20 in order to promote smooth insertion of the front end of the bottle into the gear link 38. Specifically, as shown in FIG. 41, the bottle 20, like the bottle 20 shown in FIG. 39, has two raised portions 85 spaced about 180 degrees and symmetrical to each other; the outer surfaces 85*a* of the raised portions 85 are each used as an engaging surface. The end wall of the gear link 38 is formed with four arcuate rims 202 on the inner periphery thereof. The rims 202 are convex toward the axis of the gear link 38, as viewed in a cross-section, and arranged symmetrically with respect to the axis of the link 38. As shown in FIG. 42B, the rims 202 are each inclined an angle $\alpha$ at the upper edge 202*b* thereof facing the bottle inlet of the gear link 38. Assume that when the bottle 20 is inserted into the gear link 38, the portions of the bottle 20 between the circumferential edge of the collar 24 and the shoulders 205 abut against the upper edges 202*b* of the rims 202. Then, such portions of the bottle 20 slide on the rims 202 along the inclination $\alpha$ while rotating about the axis thereof. As a result, the bottle 20 is inserted into the gear link 38 smoothly. For smooth insertion, the angle $\alpha$ should preferably be less than 30 degrees. Each rim 202 has a surface 202*a* facing the axis of the gear link 38. Such surfaces 202*a* of the rims 202 abut against the outer surfaces 85*a* of the bottle to transmit the rotation of the gear link 38 to the bottle 20.

In summary, it will be seen that the present invention has various unprecedented advantages, as enumerated below.

(1) Holding means for holding a developer container is rotatable in a substantially horizontal plane for the replacement of a developer container. This eliminates the requisite that holding means and developer container each should have a length smaller than the height of an image forming apparatus, particular to a conventional system which requires the holding means to move both horizontally and vertically. Hence, the developer container can be provided with a sufficient length.

(2) A lid is automatically attached to and detached from a mouth portion included in the developer container. Therefore, only if a person mounts the developer container to the holding means, a developer can be replenished. This not only facilitates the replacement of the developer container, but also prevents the developer from falling from the mouth portion of the developer container. In addition, the developer deposited on, for example, the inner surface of the mouth portion is prevented from falling to the outside.

(3) While the holding means is held in a position for mounting the developer container, the container can be removed with the mouth portion thereof sealed by a lid. This also prevents the developer deposited on the inner surface of the mouth portion from falling to the outside.

(4) The developer can be discharged from the developer container via the mouth portion effectively. In addition, the quantity of developer to be left unused on the inner periphery of the container is reduced.

(5) Drive transmission to the developer container is insured.

(6) In the event of replacement of the developer container, the holding means can be moved between the above-mentioned loading position and a toner replenishing position by a minimum of force. Further, when a motor, solenoid or similar actuator is used to move the holding means, use can be made of a miniature actuator.

(7) The developer container can be surely unlocked in position and, therefore, can be surely released from the holding means.

(8) The developer container can have the mouth portion thereof reduced in size, compared to a conventional container having a mouth portion whose diameter is substantially equal to the maximum diameter of the inner surface of the shoulder. The small sized mouth portion allows a minimum of developer to deposit on the inner surface thereof and prevents the developer from flying around or falling accidentally as far as possible. When the container is transported, for example, the lid closing the mouth portion of the container can be as miniature as the mouth portion.

Hence, the lid can be attached and detached by a small force, facilitating manual attachment and detachment. This is also true when a mechanism for attaching and detaching the lid automatically is installed in a developer replenishing device. In addition, such a mechanism is reduced in size.

(9) A shoulder forming a part of the developer container and having a greater diameter than the mouth portion has the inner surface thereof partly raised to the edge of the mouth portion. When the container is rotated, the inner surface of the raised portion raises the developer around the shoulder to the mouth portion, thereby causing the toner to fall via the mouth portion. As a result, the whole developer stored in the container can be used for development. Moreover, since the rate of discharge of the developer via the mouth portion is determined by, for example, the size of the raised portion, the developer can be discharged via the mouth portion stably.

(10) A person intending to replace the developer container is prevented from removing the lid of the developer container by accident. Otherwise, the developer would fall from the container to smear the surroundings.

Various modifications will become possible for those skilled in the art after receiving the teachings of the present disclosure without departing from the scope thereof.

What is claimed is:

1. A toner container storing toner therein, wherein said toner container is held in a horizontal position and rotated about an axis thereof to thereby discharge said toner via an end portion of said toner container, and wherein said toner container has a circumferential wall having a substantially uniform thickness and has an uneven outer circumferential surface.

2. A container as claimed in claim 1, wherein said uneven outer circumferential surface includes a portion not parallel to a plane containing said axis or a plane containing a bottom of said container, whereby a stream of air is produced around said container in an axial direction of said container during rotation of said container.

3. A container as claimed in claim 2, wherein said uneven outer surface is configured such that the stream of air flows toward an open portion.

4. A toner container storing toner therein, wherein said toner container is held in a horizontal position and rotated to thereby discharge said toner via an opening located on an axis of rotation of said toner container and having a diameter smaller than a diameter of said toner container.

* * * * *

UNITED STATES PATENT AND TRADEMARK OFFICE
Certificate

Patent No. 5,822,663 Patented: October 13, 1998

On petition requesting issuance of a certificate for correction of inventorship pursuant to 35 U.S.C. 256, it has been found that the above-identified patent, through error and without deceptive intent, improperly sets forth the inventorship.

Accordingly, it is hereby certified that the correct inventorship of this patent is: Hideo Ichikawa, Numazu, Japan; and Seiji Ozawa, Numazu, Japan.

Signed and Sealed this Second Day of October 2001.

ARTHUR T. GRIMLEY
*Supervisory Patent Examiner*
Art Unit 2852